US007506872B2

(12) United States Patent
Uzuanis

(10) Patent No.: US 7,506,872 B2
(45) Date of Patent: Mar. 24, 2009

(54) PUZZLE

(75) Inventor: Michael R. Uzuanis, 9 S. 662 Lorraine Dr., Hinsdale, IL (US) 60521

(73) Assignee: Michael R. Uzuanis, Burr Ridge, IL (US)

( * ) Notice: Subject to any disclaimer, the term of this patent is extended or adjusted under 35 U.S.C. 154(b) by 0 days.

(21) Appl. No.: 11/279,843

(22) Filed: Apr. 14, 2006

(65) Prior Publication Data

US 2006/0261547 A1 Nov. 23, 2006

Related U.S. Application Data

(60) Provisional application No. 60/671,932, filed on Apr. 15, 2005.

(51) Int. Cl.
*A63F 9/10* (2006.01)

(52) U.S. Cl. ..... 273/157 R

(58) Field of Classification Search ..... 273/157 R, 273/155, 156, 159; D21/480; 446/119, 122, 446/370, 374, 378, 390; 602/61, 74
See application file for complete search history.

(56) References Cited

U.S. PATENT DOCUMENTS

| | | | | | |
|---|---|---|---|---|---|
| 176,532 | A | | 4/1876 | Hughes | |
| 207,346 | A | | 8/1878 | Clow | |
| 393,816 | A | | 12/1888 | Chandler | |
| 528,141 | A | | 10/1894 | Brooks | |
| D26,009 | S | | 9/1896 | Stophlet | |
| 781,050 | A | | 1/1905 | Curtis | |
| 942,465 | A | | 12/1909 | Sauer | |
| 994,227 | A | * | 6/1911 | Whitelaw | 273/157 R |
| 1,050,141 | A | * | 1/1913 | Joy | 273/156 |
| 1,547,967 | A | | 7/1925 | Shilman | |
| 1,651,960 | A | | 12/1927 | Miller | |
| D91,130 | S | | 12/1933 | Cascadden | |
| 1,944,696 | A | | 1/1934 | Reichl | |
| 1,946,683 | A | | 2/1934 | Gabriel | |
| 2,429,027 | A | * | 10/1947 | Myers | 273/157 R |
| 2,506,189 | A | * | 5/1950 | Attridge | 273/157 R |
| 2,585,781 | A | * | 2/1952 | Johnson | 446/99 |
| 2,617,654 | A | * | 11/1952 | Nolan et al. | 273/156 |
| 2,825,178 | A | | 3/1958 | Hawkins | |
| 2,952,462 | A | * | 9/1960 | Planin | 273/157 R |
| 3,236,007 | A | * | 2/1966 | Abeson | 446/374 |
| 3,334,798 | A | | 8/1967 | Pezely, Jr. et al. | |
| D215,949 | S | | 11/1969 | Markusen | |
| 3,699,714 | A | * | 10/1972 | Johnson et al. | 446/374 |
| 3,709,225 | A | * | 1/1973 | Sobel | 604/303 |
| D235,672 | S | * | 7/1975 | Root | D21/480 |
| D240,647 | S | | 7/1976 | Root | |
| 3,998,003 | A | | 12/1976 | Rosenbaum | |
| 4,083,123 | A | * | 4/1978 | Livermore | 273/157 R |
| 4,233,775 | A | * | 11/1980 | Neufeld | 446/370 |
| 4,325,552 | A | * | 4/1982 | Glasheen | 273/153 P |
| 4,361,328 | A | | 11/1982 | Stein et al. | |

(Continued)

*Primary Examiner*—Steven Wong
(74) *Attorney, Agent, or Firm*—Anne McGovern Burkhart

(57) ABSTRACT

A puzzle having only a single or, at most, only a few pieces is made out of a material possessing substantially plastic flexibility but also substantial dimensional stability. Each puzzle piece has a length, periphery or surface area which is at least greater than that of the assembled puzzle. Preferably the puzzle piece is branched. The puzzle can take two-dimensional and three-dimensional forms.

5 Claims, 26 Drawing Sheets

U.S. PATENT DOCUMENTS 4,384,717 A * 5/1983 Morris ..... 273/156
4,469,331 A 9/1984 Rinker
4,561,097 A 12/1985 Siegel
4,799,680 A 1/1989 Weimar
4,809,980 A 3/1989 Bertrand
4,919,427 A * 4/1990 Keidar et al. ..... 273/155
5,046,988 A 9/1991 Bennett
5,108,100 A * 4/1992 Essebaggers et al. .... 273/153 R
5,292,255 A 3/1994 Goldwasser
5,299,804 A 4/1994 Stevens
5,302,148 A 4/1994 Heinz
5,310,378 A * 5/1994 Shannon ..... 446/268
5,318,301 A * 6/1994 Asch ..... 273/155
5,322,284 A 6/1994 El-Agamawi
5,324,037 A * 6/1994 Greeson ..... 273/155
5,338,034 A 8/1994 Asch
5,346,215 A 9/1994 Asch
5,351,957 A * 10/1994 Scott ..... 273/157 R
5,396,713 A 3/1995 Valdez
5,445,380 A 8/1995 Polsky
5,564,704 A 10/1996 Yang
D375,330 S 11/1996 Ritzman
5,575,658 A 11/1996 Barnard
D378,536 S 3/1997 Fireman et al.
5,628,513 A * 5/1997 Soriano ..... 273/157 R
D385,311 S 10/1997 Negahban
5,860,650 A * 1/1999 Scobbie et al. ..... 273/157 R
6,135,851 A 10/2000 Drake et al.
6,221,457 B1 4/2001 Rasmussen
6,273,979 B1 8/2001 Lastoria
6,293,547 B1 9/2001 Shaw et al.
6,536,764 B1 * 3/2003 Spitzer ..... 273/153 S
D475,094 S 5/2003 Ko
6,793,497 B2 9/2004 Herman et al.
D499,151 S 11/2004 Arabian
D500,347 S 12/2004 Oakley
6,883,802 B2 4/2005 Rom
2006/0097448 A1 * 5/2006 Kinberg ..... 273/157 R

* cited by examiner

PUZZLE

RELATED APPLICATIONS

This application claims priority under 35 U.S.C. §119(e) to U.S. Provisional Patent Application No. 60/671,932 filed Apr. 15, 2005, entitled PUZZLE and owned by the applicant hereof. The specification and drawings of said provisional patent application are fully incorporated by reference herein.

BACKGROUND OF THE INVENTION

Various types of puzzles have been developed which have a multiple of pieces, such as a hundred or more. Generally, to increase the difficulty and complexity one decreases the relative size and increases the relative number of puzzle pieces.

Conventional puzzles have as their objective the assembly of the puzzle from a plurality of separate pieces. In the well-known jigsaw format, an image, such as a scenic photograph, is applied to a cardboard substrate. This image is then cut up into dozens or hundreds of separate pieces by a die. Each piece is flat, typically has an ability to interlock in an interference fit with surrounding pieces so as to stay together after assembly, is rigid or nearly so, and is dimensionally stable. One problem with multiple-piece puzzles is that individual pieces often become lost, greatly diminishing the enjoyment a user obtains in assembling the puzzle.

SUMMARY OF THE INVENTION

The present invention presents a new approach to puzzles, in that it provides a puzzle with only one or a few pieces. In one aspect of the present invention, the piece or pieces of the puzzle are formed of a substantially plastically flexible material and which are also substantially dimensionally stable, and have a length which is at least greater than the longest dimension of the puzzle into which the piece or pieces are assembled. Preferably, the puzzle piece length is many times that of the assembled puzzle. In some embodiments, the puzzle piece length is at least an order of magnitude greater than the assembled puzzle length.

According to another aspect of the invention, each of the puzzle piece or pieces has a surface area or peripheral length which is greater than the puzzle into which the piece or pieces are assembled. For substantially two-dimensional (flat) puzzles, one of the peripheral length and circumference of the puzzle piece is compared with a periphery, outer margin or circumference of the assembled puzzle. For more three-dimensional puzzles, the surface area of each puzzle piece is greater than the surface area of the assembled puzzle.

In one embodiment, the puzzle of the invention has only one piece. Another preferred feature of the invention is that the puzzle piece or pieces are branched, dendritic or fractal. The degree to which the puzzle piece(s) are branched and sub-branched is predetermined according to the degree of desired complexity. The course of the puzzle piece may undulate back and forth across the substrate from which it has been cut, and/or may have an initial portion of the length which encloses the remainder in order to enhance the structural integrity of the assembled puzzle.

Materials useful for making the puzzle have certain common characteristics. They are preferably plastically flexible, meaning that they may be bent and then tend to stay bent, allowing them to be placed in a disorganized or disassembled condition. On the other hand, the material should have substantial dimensional stability, so that after the piece(s) are taken apart or intentionally disorganized, their shape will remain true enough that they can be reassembled.

In one embodiment, the puzzle is relatively flat and, in its assembled condition, presents an image on at least one side. The reverse side may be blank, may consist of another image, or have a random design on it so as to be devoid of any clues on how to assemble it. In one embodiment of the invention, the assembled puzzle can have a random or irregular perimeter to deprive it of easily identified "edge" or "corner" pieces. Alternatively the perimeter could be a square, rectangle, triangle, circle, polygon, ellipse or any other known geometric shape.

As an alternative to a mostly two-dimensional puzzle that in its assembled condition is flat and conforms to a plane, the puzzle may instead conform to a three-dimensional surface, such as all or portions of a cube, prism, cylinder, sphere, prolate or oblate spheroid, truncated paraboloid, truncated hyperboloid of one or two sheets, other solids of rotation, pyramid, cone, frustum, toroid or other known shapes. The support surface may be curved. The three-dimensional shape may be a partial or complete representation of a person, animal or well-known object, such as an article, building, vehicle or piece of sports equipment. The support surface or mandrel can be solid or it can be a shell. In yet another embodiment, the puzzle piece or pieces could extend throughout a volume of such a three-dimensional figure rather than be confined to a surface thereof.

While one aspect of the invention provides a puzzle of one piece, other puzzles according to the invention may have more pieces, such as two to ten. It is preferred that each such separate piece comprise at least five percent of the whole of the object to be assembled, whether a surface or a solid.

BRIEF DESCRIPTION OF THE DRAWINGS

Further aspects of the invention and their advantages can be discerned in the following detailed description, in which like characters denote like parts and in which.

DETAILED DESCRIPTION

Figure 1:
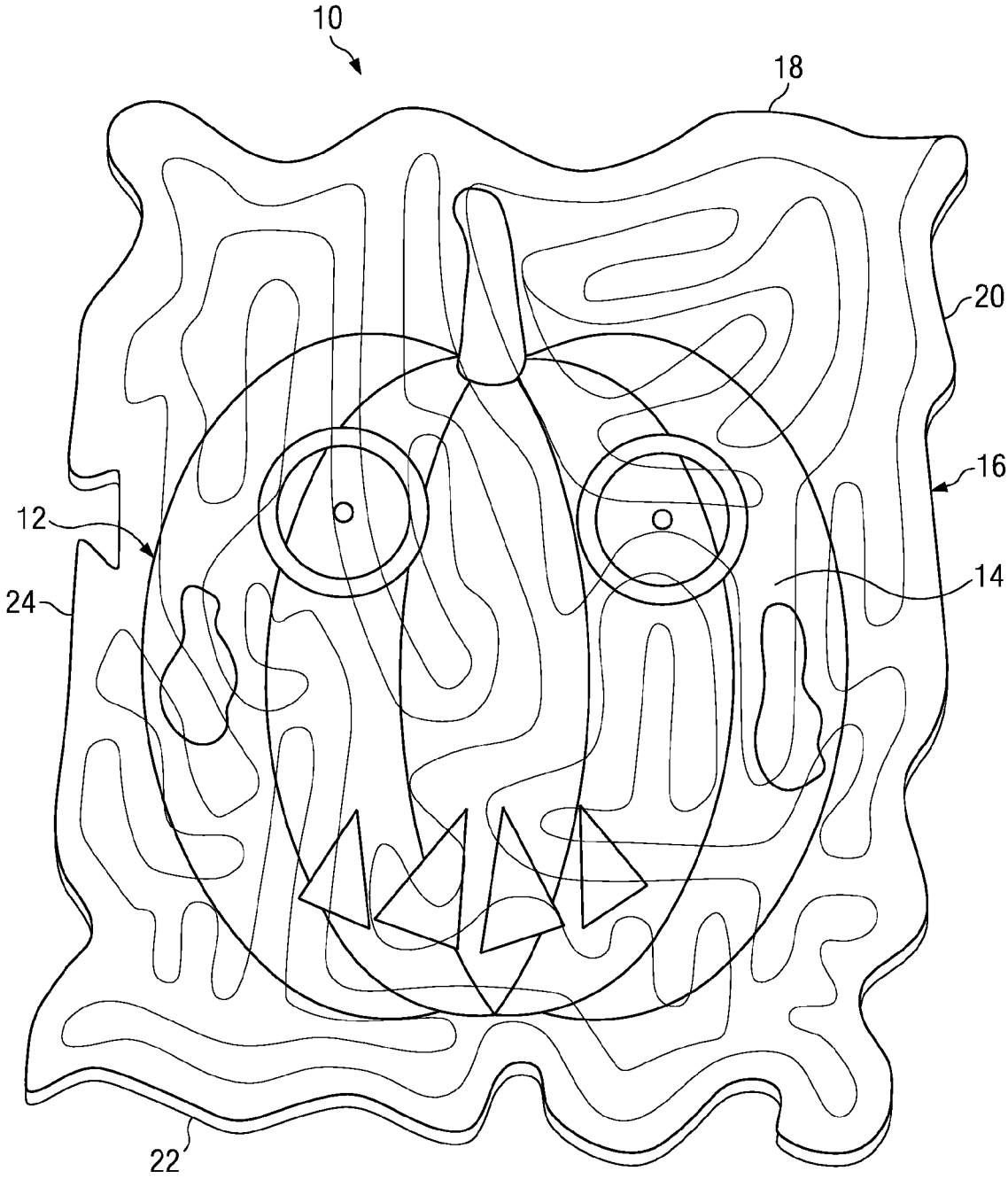
FIG. 1 is a plan view of a first embodiment of the invention, showing a planar puzzle in an assembled condition and being constituted by a single piece.

Referring to FIG. 1, a first embodiment 10 of the present invention has a conventional image 12 printed on its face, in this instance including a jack o'lantern 14. This embodiment consists of a single piece 16. When assembled, puzzle 10 has a random or irregular perimeter 18, 20, 22, 24, without straight edges or sharp corners. The puzzle piece 16 has branches, sub-branches, sub sub-branches, etc.; alternatively stated, a puzzle according to the invention can take a fractal or dendritic form.

Figure 2A:
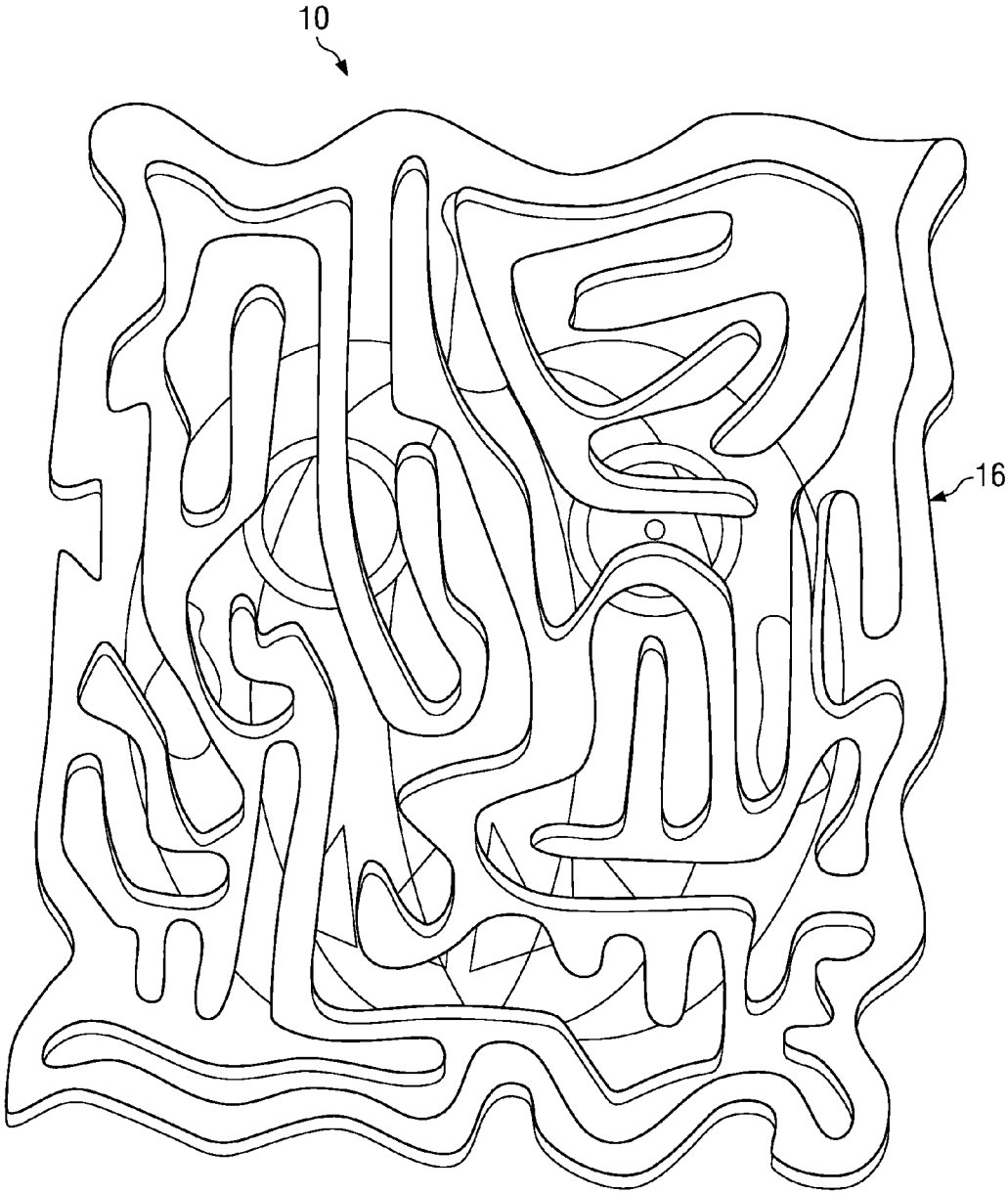
FIG. 2A is a top view of the puzzle shown in FIG. 1 showing the puzzle in somewhat disassembled condition.
Figure 2B:
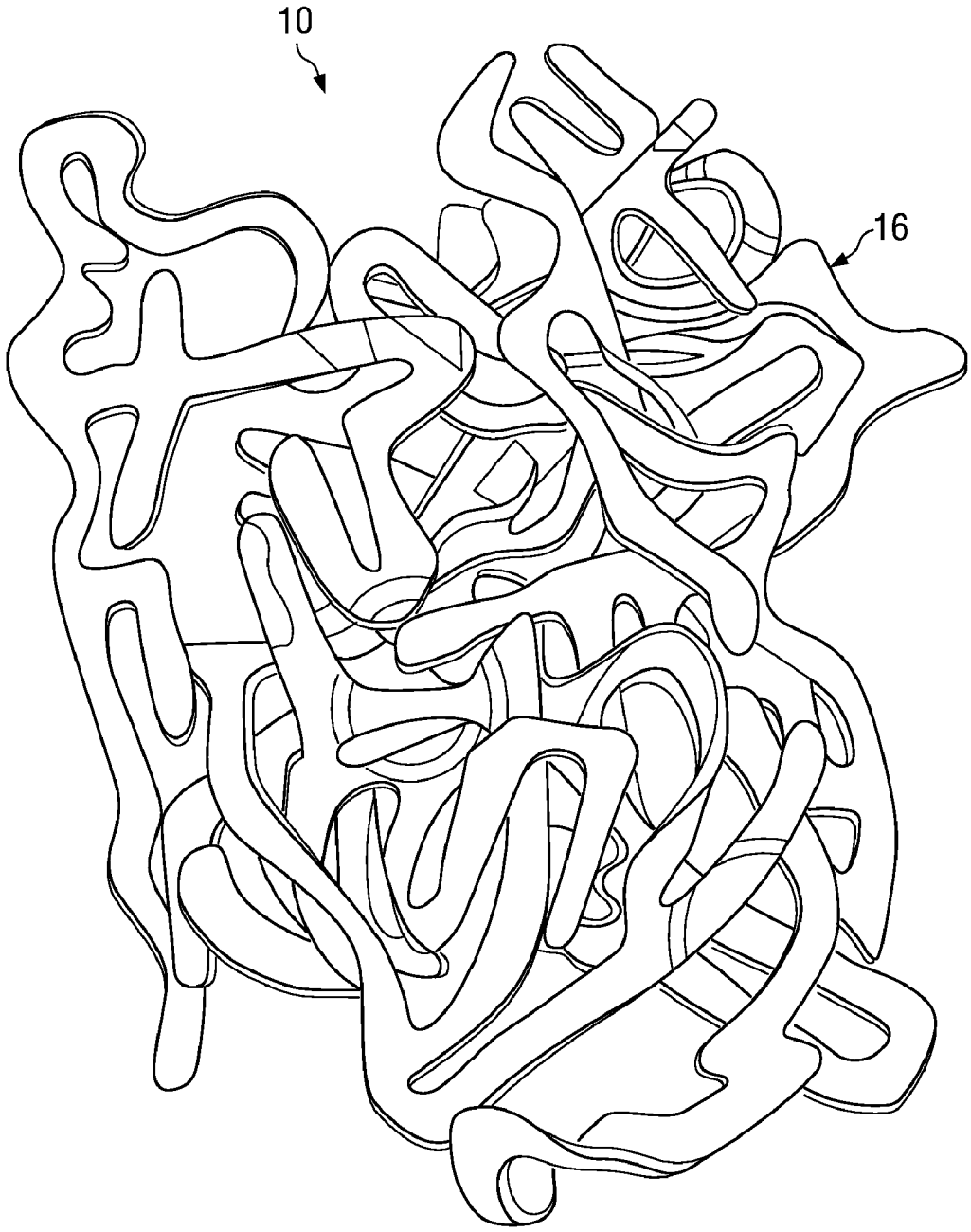
FIG. 2B is a top view of the puzzle shown in FIG. 1, but showing the puzzle in a completely disassembled and randomized condition, as might be initially presented to a user.

FIG. 2A shows the puzzle piece 16 of FIG. 1 somewhat pulled apart. FIG. 2B shows the puzzle piece 16 of FIGS. 1 and 2A in a more random and jumbled disposition as would face one about to solve the puzzle. FIGS. 2A and 2B illustrate a desired characteristic of the invention, in that the puzzle piece 16, and body 10 which it composes, is fabricated of a substantially plastically flexible yet substantially dimensionally stable piece of material. That is, once the piece is bent or rearranged from an ordered condition to a disordered condition and vice versa, the piece has a tendency to remain in the last condition to which it was moved. The piece 16 can have some elasticity to it, but the elasticity must not be so pronounced that the puzzle piece springs back to an initial configuration. The piece 16 (and the material 10 from which it is made) should not have a lot of "memory" in this respect. On the other hand, the body 10 must exhibit at least a modicum of dimensional stability, otherwise it won't be easily capable of reassembly.

Figure 3A:
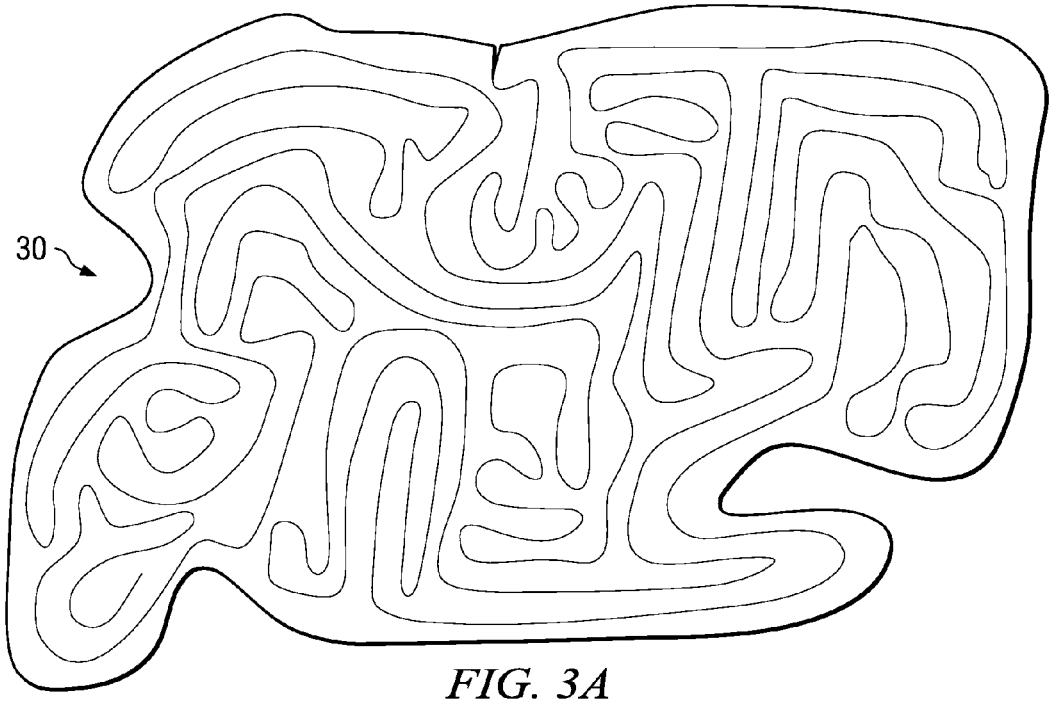
FIG. 3A is a plan view of a second embodiment of the invention, in which the assembled puzzle has an irregular or random periphery.

FIG. 3A shows another embodiment 30 of the puzzle of the present invention, devoid of an image so that the puzzle is more difficult to solve. This embodiment has no image clues on at least one of its sides. The reverse side (not shown) could have an image on it such that the puzzle presents two levels of difficulty, with the easier one using the image. The width of the puzzle piece could be reduced or widened to make the puzzle more difficult or easier.

Figure 3B:
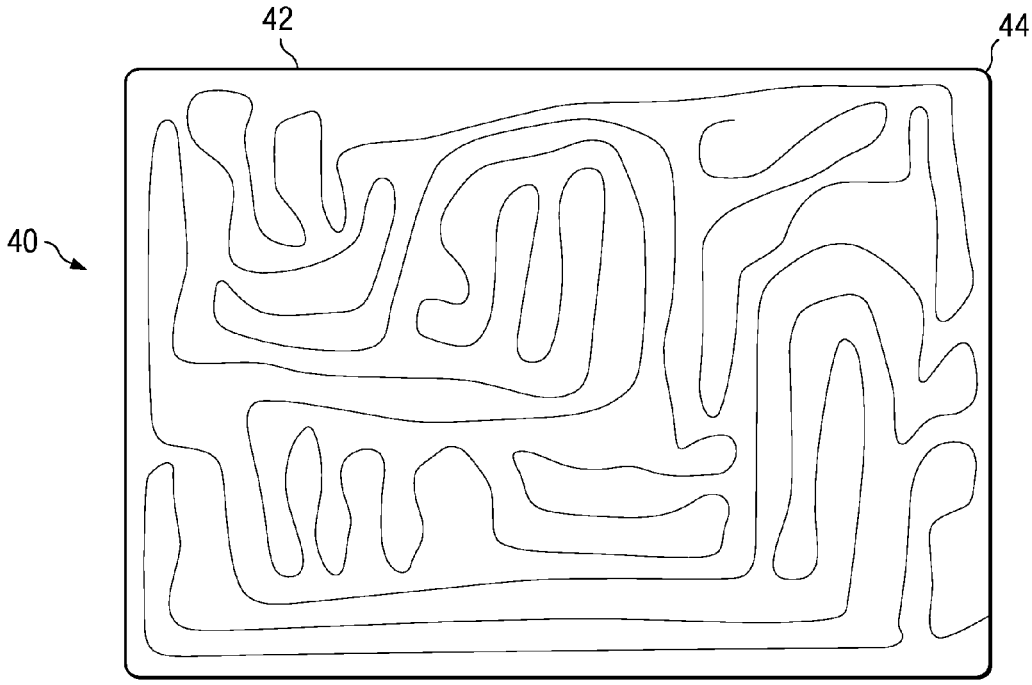
FIG. 3B is a plan view of a third embodiment of the invention, in which the assembled puzzle has a rectangular perimeter.

FIG. 3B shows an embodiment in which a puzzle 40 according to the invention has a more conventional shape in an assembled condition, in this case a rectangle having a straight or linear side 42 and four sharp corners 44. The presence of these features makes the puzzle easier to solve.

Figure 3C:
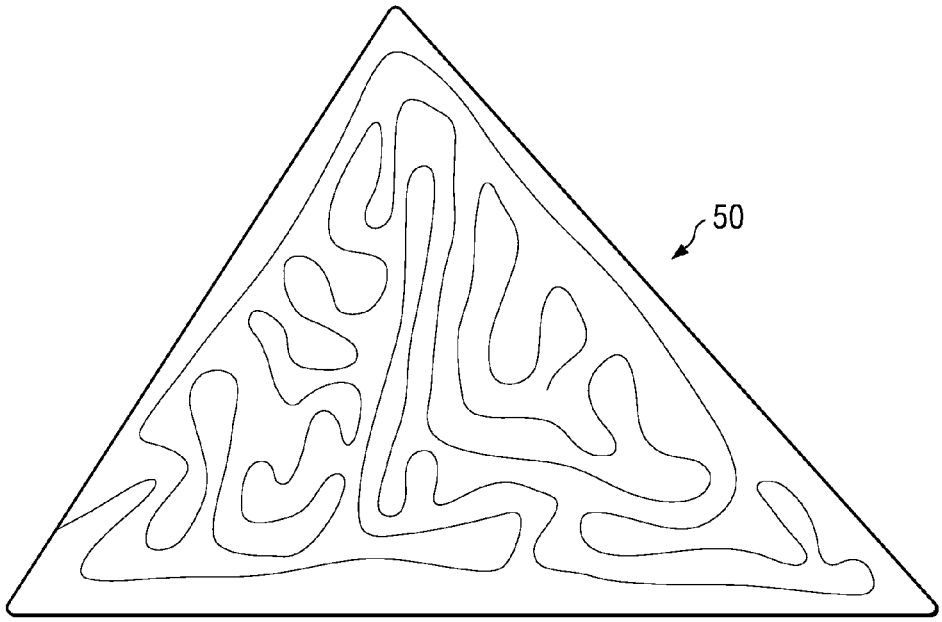
FIG. 3C is a plan view of a fourth embodiment of the invention, in which a perimeter of the assembled puzzle is triangular.
Figure 3D:
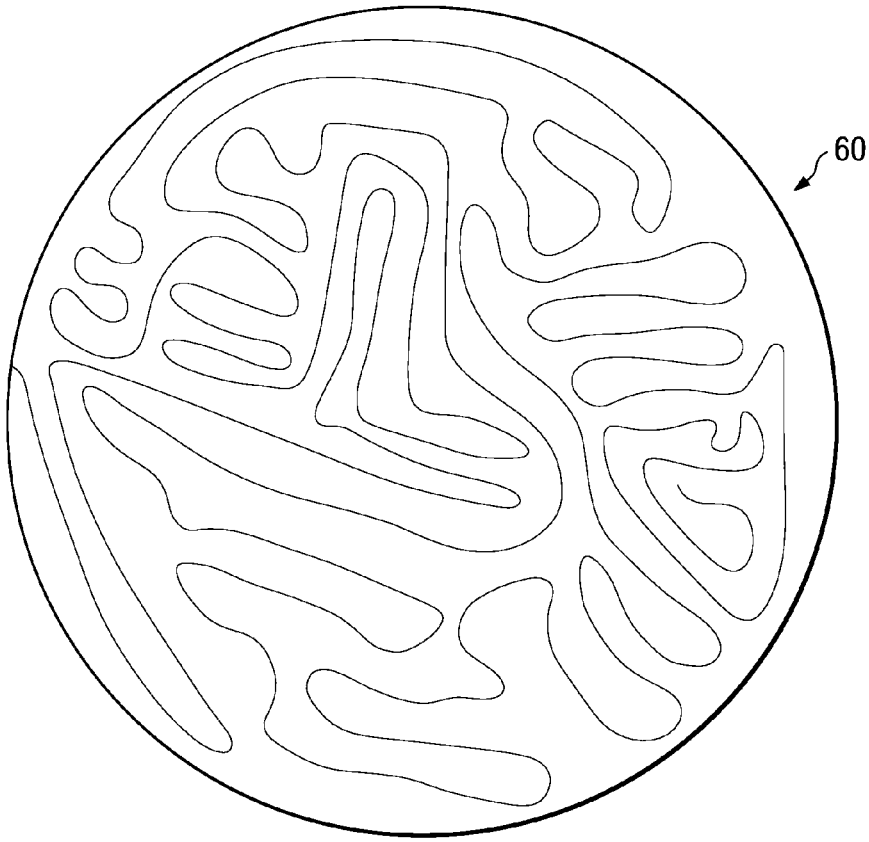
FIG. 3D is a plan view of a fifth embodiment of the invention, in which a perimeter of the assembled puzzle is circular.

FIGS. 3C and 3D show puzzles 50 and 60, and illustrate how assembled puzzles according to the present invention can take various shapes, in this case a triangle and a circle or disk.

Figure 4A:
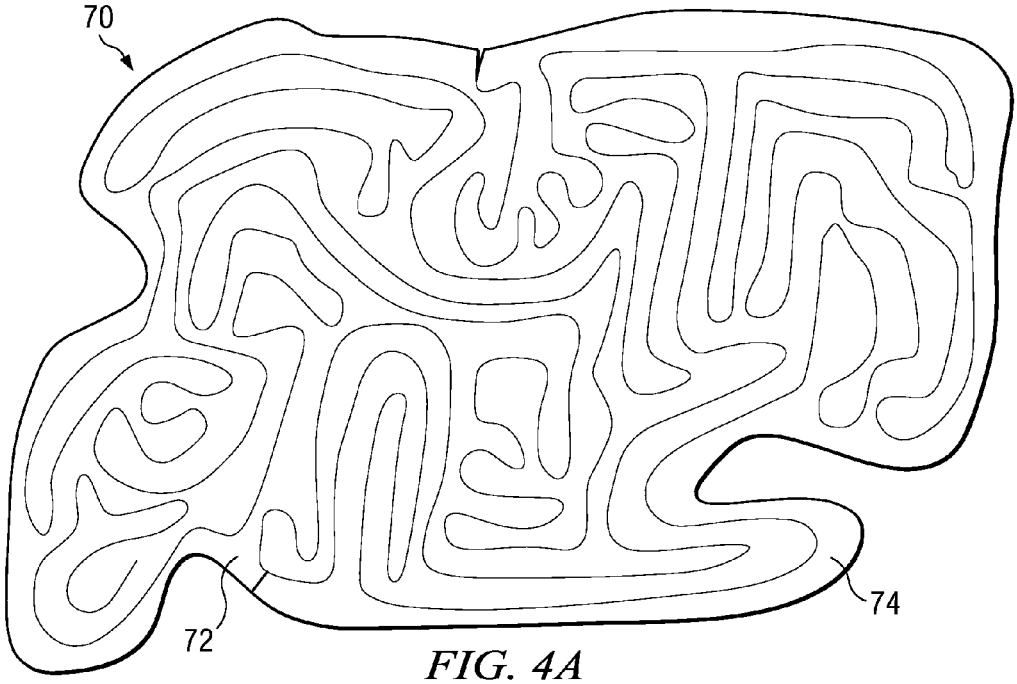
FIG. 4A is a plan view of a sixth embodiment of the invention, in which the puzzle consists of two separate pieces.
Figure 4B:
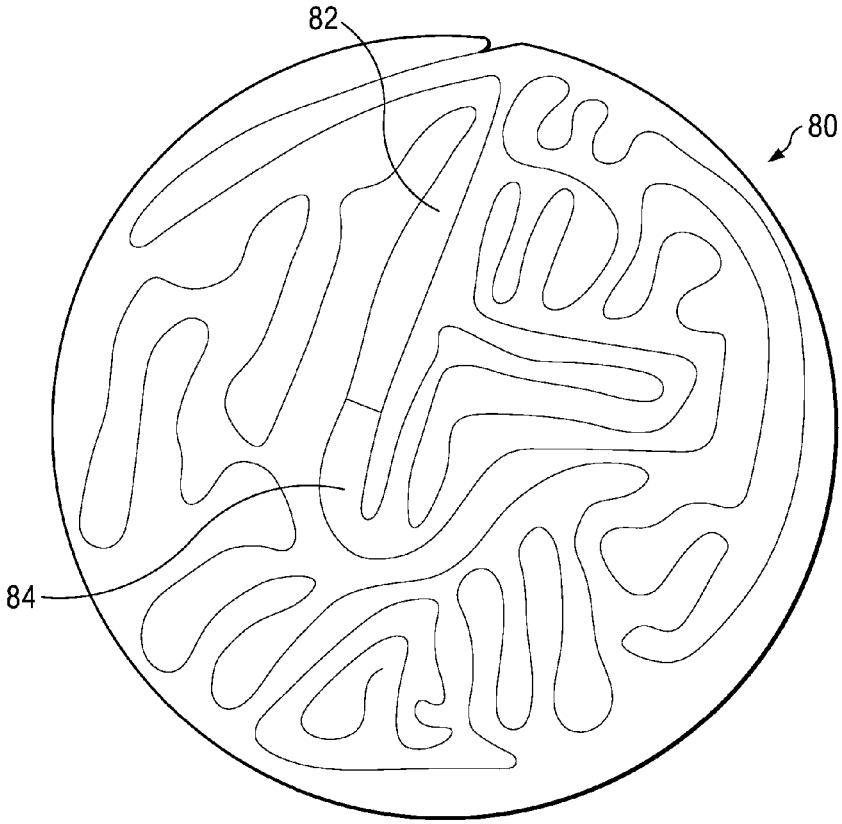
FIG. 4B is a plan view of a seventh embodiment of the invention, in which the perimeter of the puzzle is circular and has two separate pieces.

FIGS. 4A and 4B show puzzles 70 and 80 having shapes similar to FIGS. 3A and 3B, respectively (although puzzle 70 is only roughly rectangular). However these puzzles have multiple pieces. Puzzle 70 has pieces 72 and 74, while puzzle 80 has pieces 82 and 84. In a preferred but multiple-piece embodiment, the number of puzzle pieces can vary between two and ten. It is preferred that no piece make up less than five percent of the body of the puzzle.

Figure 5:
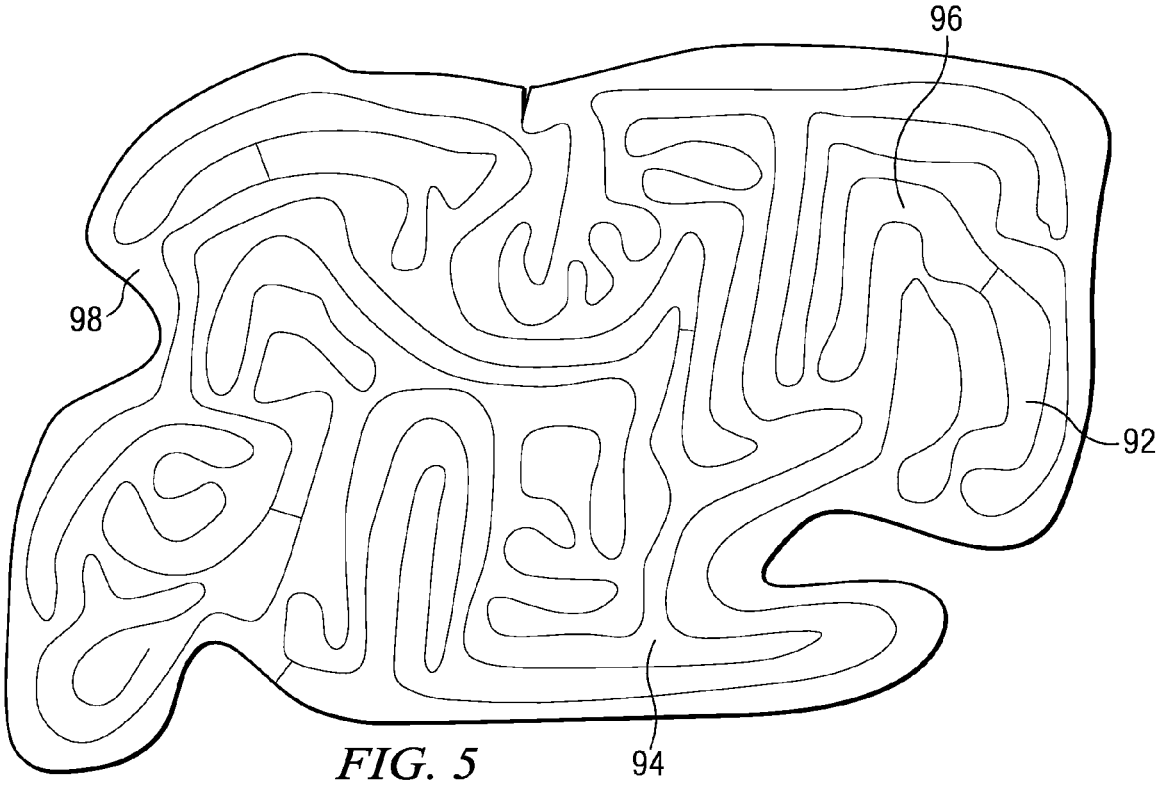
FIG. 5 is a plan view of an eighth embodiment of the invention, in which the puzzle has multiple pieces.

FIG. 5 shows a puzzle embodiment 90, somewhat like that of FIGS. 3A and 4A, but having multiple pieces, in this instance many pieces 92, 94, 96, 98, etc.

Figure 6:
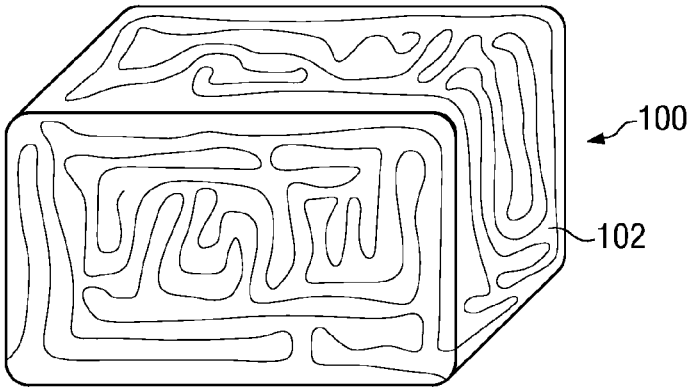
FIG. 6 is an isometric view of a ninth embodiment of the invention, in which the assembled puzzle is a solid having three dimensions, and in which a single piece is a shell which conforms to a mandrel or support surface.
Figure 6A:
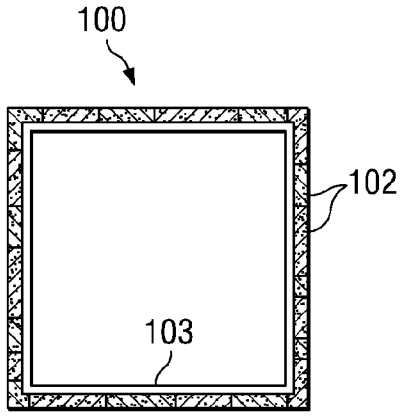
FIG. 6A is a cross sectional view of the puzzle shown in FIG. 6.

FIG. 6 shows a puzzle 100 in a three dimensional shape having a single piece 102 which will form a block-shaped puzzle. In the embodiments described previously herein, the puzzles were thin in a depth direction, substantially two-dimensional and substantially conformed to a plane in a length and width direction. In contrast, puzzle 100 has a substantial third dimension that is of the same order of magnitude as its other two dimensions. In this embodiment, the piece 102 is assembled as a relatively thin or flat shell or layer which is supported by a three-dimensional support substrate 103 (see FIG. 6A). The puzzle 100 is one of a class of puzzles according to the invention which are assembled on a nonplanar surface 103. This support surface can be a geometric solid such as a sphere, or a portion of such a solid; the surface can be convex or concave curved surface or one which is irregular. Preferably the surface provides structural support for the preferably flexible puzzle piece(s) 102.

Figure 7:
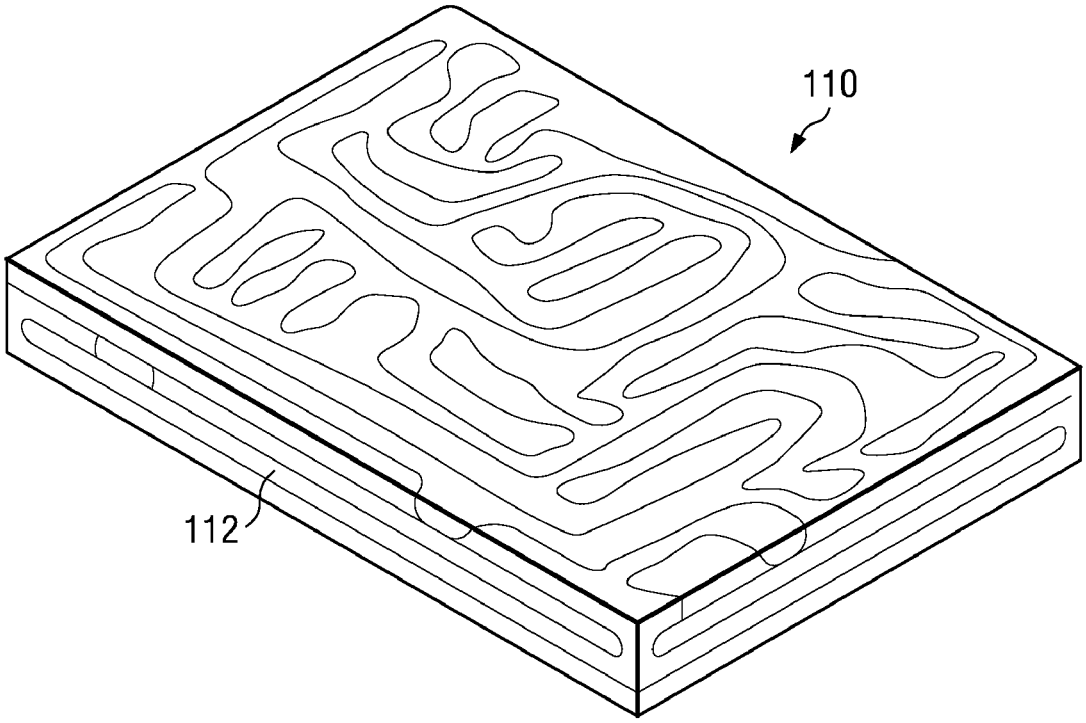
FIG. 7 is an isometric view of a tenth embodiment of the invention, in which the assembled puzzle is substantially three-dimensional, has a plurality of layers, but is constituted by a single piece.

FIG. 7 shows yet another embodiment 110 in a substantially three-dimensional shape which is made in layers, in this instance four. Alternatively the puzzle could have two, three, five or more layers. Embodiment 110 is made of a single piece 112.

Figure 8:
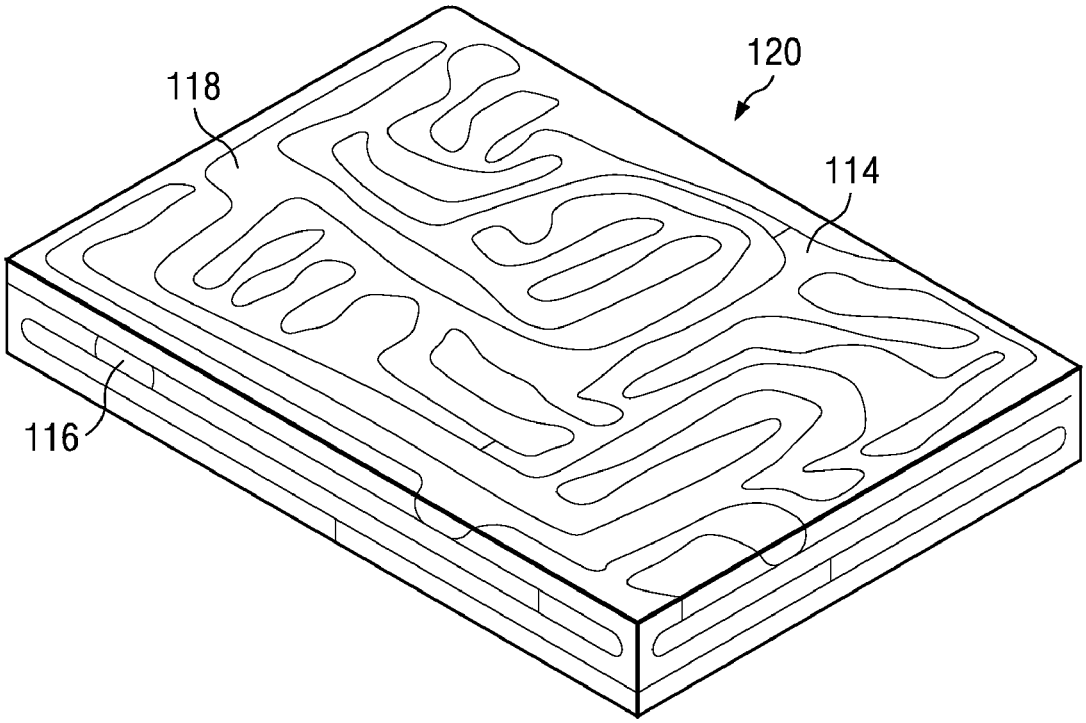
FIG. 8 is an isometric view of an eleventh embodiment of the invention, in which the assembled puzzle has multiple layers and more than one separate piece.

FIG. 8 shows yet another embodiment 120, again made up of several layers, here four. Puzzles according to this aspect of the invention could be made to incorporate two, three, five or more layers. Puzzle 120 has been chosen to be composed of several separate pieces 114, 116, 118, etc.

Figure 9:
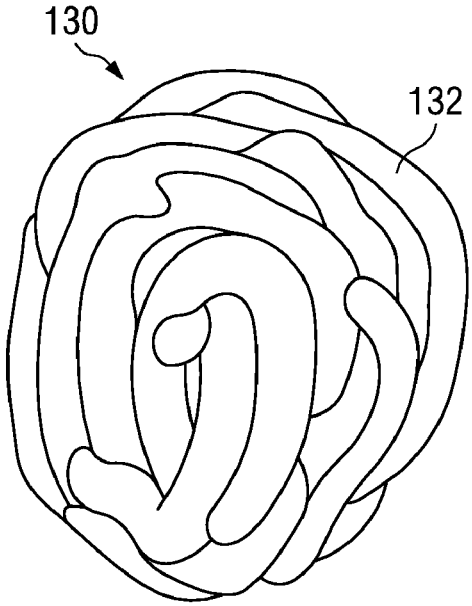
FIG. 9 is a view of a further three dimensional puzzle according to the invention.
Figure 9A:
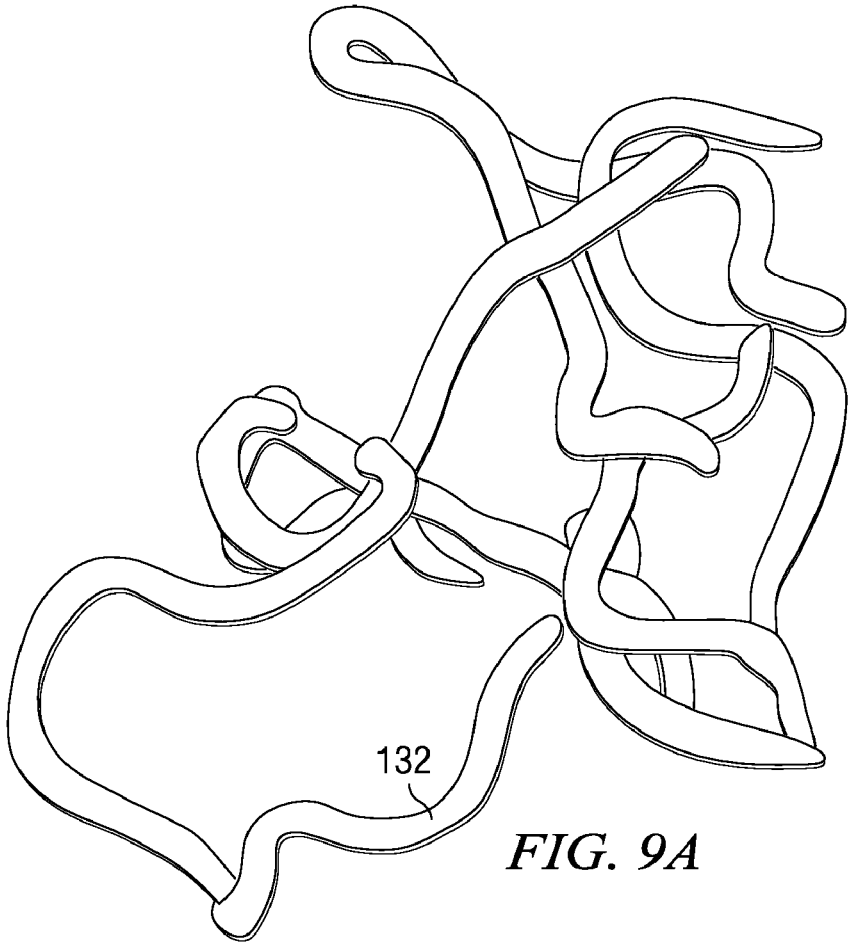
FIG. 9A is a view of the puzzle of FIG. 9, showing the single piece thereof in a separated or disordered condition.
Figure 9B:
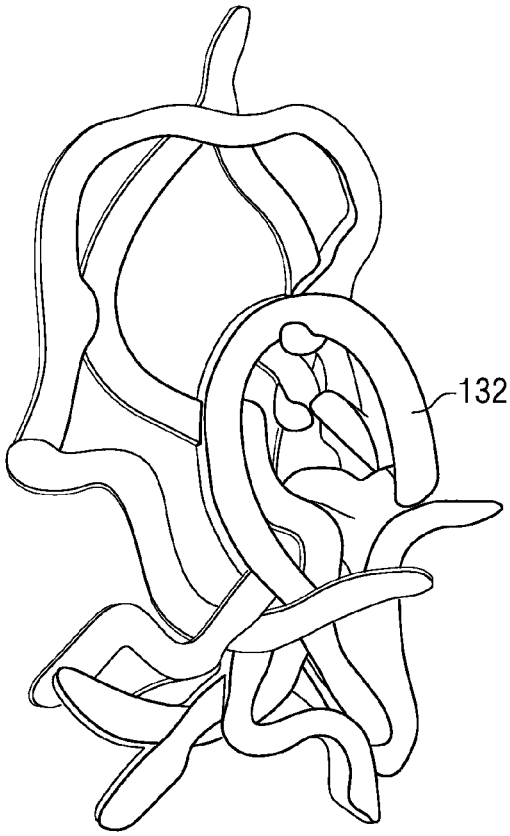
FIG. 9B is a view of the puzzle piece shown in FIG. 9B, but shown in a more occluded and even more disordered condition.

FIG. 9 shows a three dimensional volume puzzle embodiment 130 of the present invention in the form of a block which is made up of the single piece 132. In its assembled condition, puzzle 130 is devoid of planar surfaces or sharp corners. FIG. 9A shows the single piece 132 in a disassembled and largely separated arrangement. FIG. 9B shows the single piece 132 in a disordered condition that is more compacted and occluded, with the various parts of the piece piled onto each other as they might appear to a person starting to solve the puzzle. The arrangement shown in FIG. 9B is more like that faced by a person setting out to solve the puzzle.

Figure 10A:
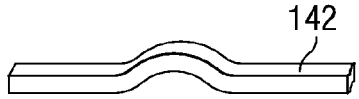
FIG. 10A is a view of a portion of a relatively shallow puzzle piece.
Figure 10B:
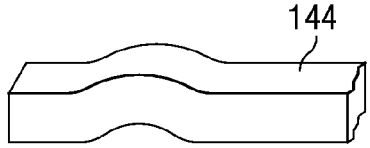
FIG. 10B is a view of a portion of a relatively deep or thick puzzle piece.
Figure 10C:
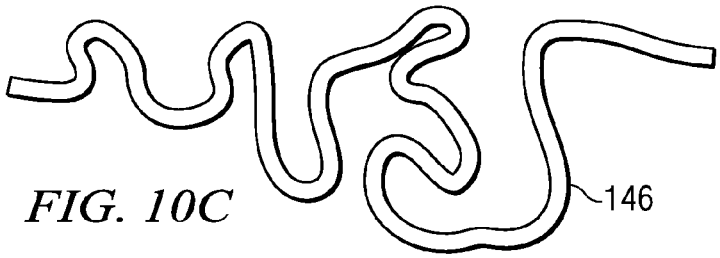
FIG. 10C is a view of a portion of a relatively narrow or thin puzzle piece.
Figure 10D:
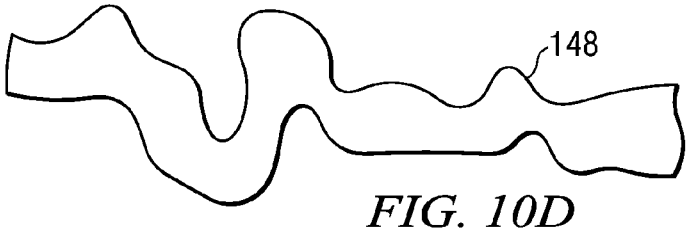
FIG. 10D is a view of a portion of a relatively wide puzzle piece.

Referring to FIGS. 10A, B, C, and D, portions of a thin puzzle piece 142, a thick or deep piece 144, a narrow piece 146 and a wide piece 148 are shown. The thicker and/or wider the piece, the easier to solve the puzzle. Likewise, the thinner and/or narrower the piece, the more difficult to solve the puzzle. The puzzle fabricator can also select the puzzle piece to be more or less elastic and more or less plastic. As elasticity increases, the puzzle will become easier to solve, as the puzzle piece "helps" the user in tending to reorder itself to the condition it was in prior to its being disordered. As plasticity increases, the puzzle piece will tend to stay in the last condition it was placed, also aiding the user in manipulating the puzzle. A perfectly flexible piece which flops about will likely be more difficult to solve than ones which are more rubbery or waxy.

Figure 21:
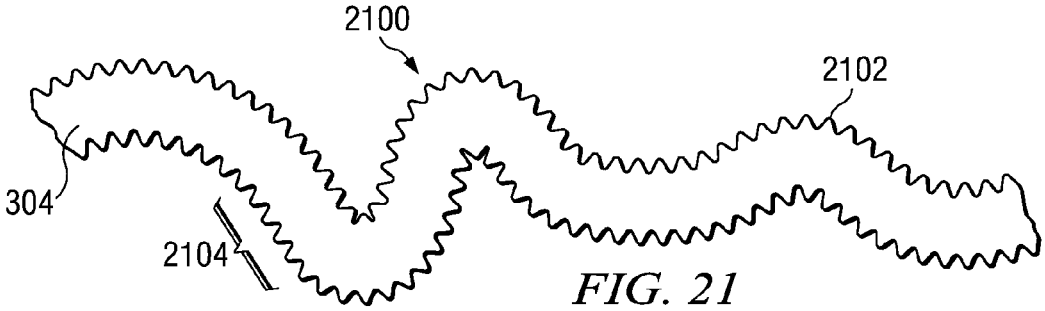
FIGS. 21, 22 and 23 illustrate blank forms of the present invention upon which a user can draw an image or images.

FIG. 21 shows a single puzzle piece 2100 of the present invention whose edges 2102 are in a saw-toothed pattern 2104 on all or a portion of its perimeter. The edges 2102 as shown are one example of a patterned edge for a puzzle piece. Other patterned edges include scallops, waves and any other repetitive pattern.

Figure 11:
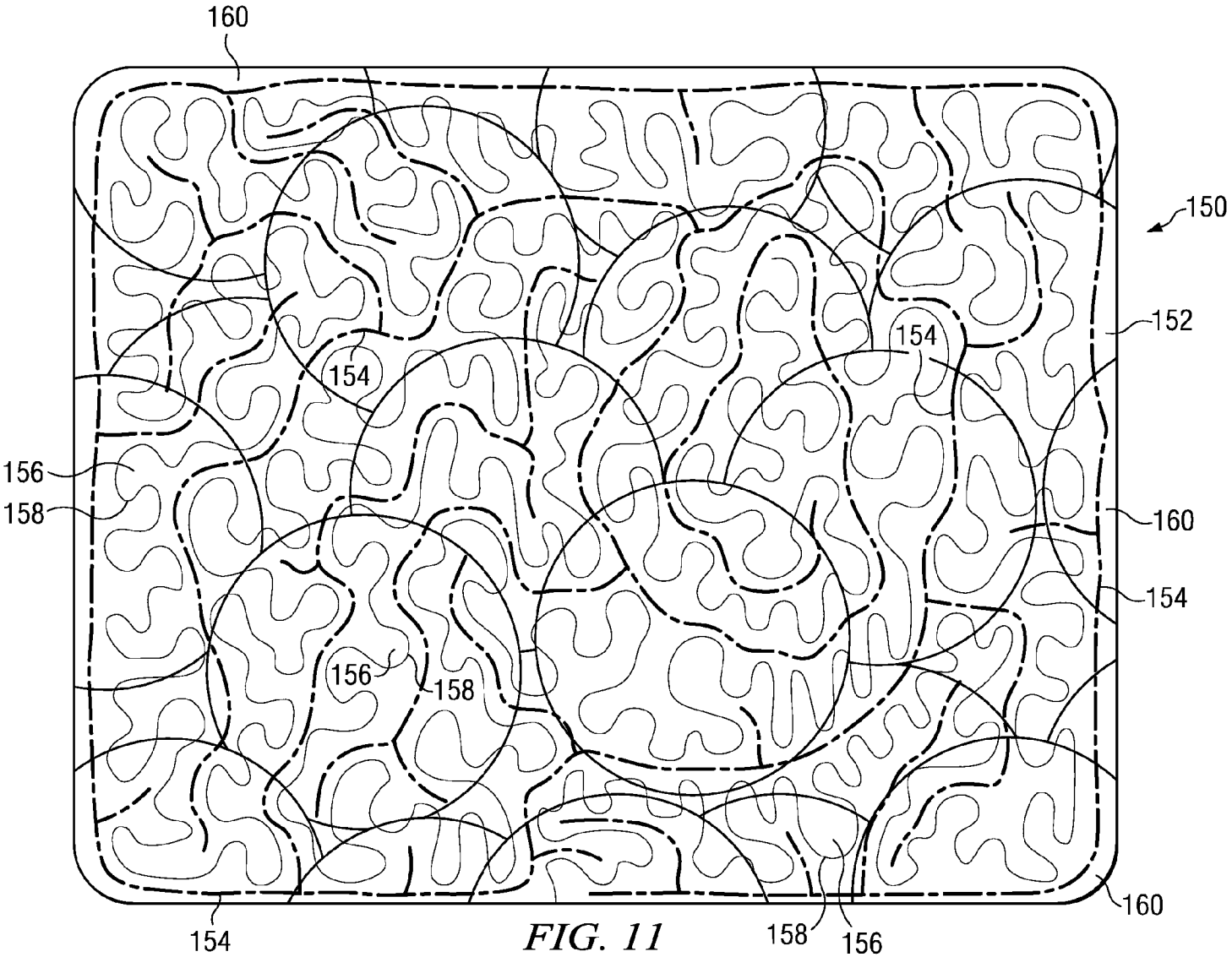
FIG. 11 is a view of flat, substantially rectangular embodiment of the invention made out of a single puzzle piece, a lengthwise axis or centerline of the piece and of principal branches of the piece being superimposed.
Figure 12A:
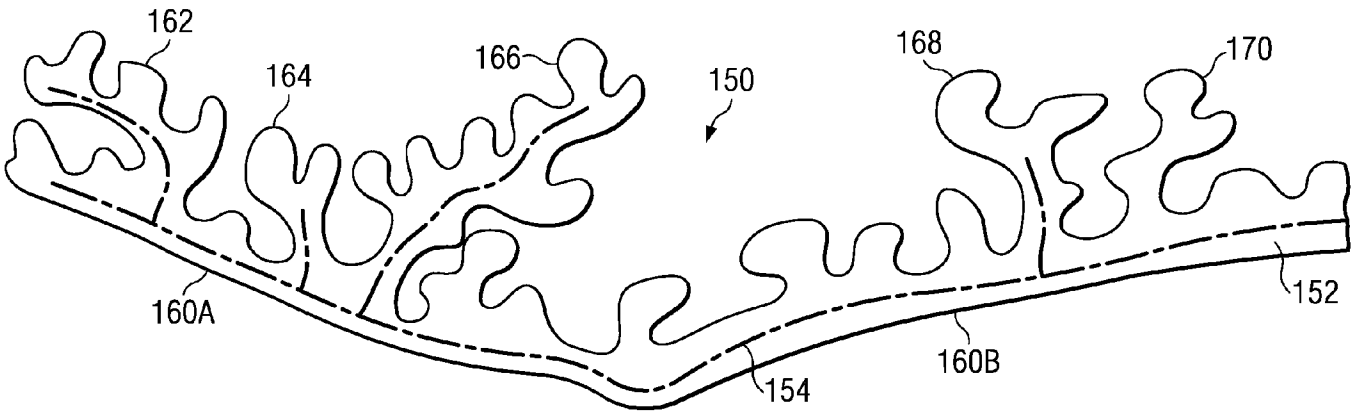
FIGS. 12A-12F together constitute another view of the invention in which the single puzzle piece has been stretched out into a mostly linear condition.
Figure 12B:
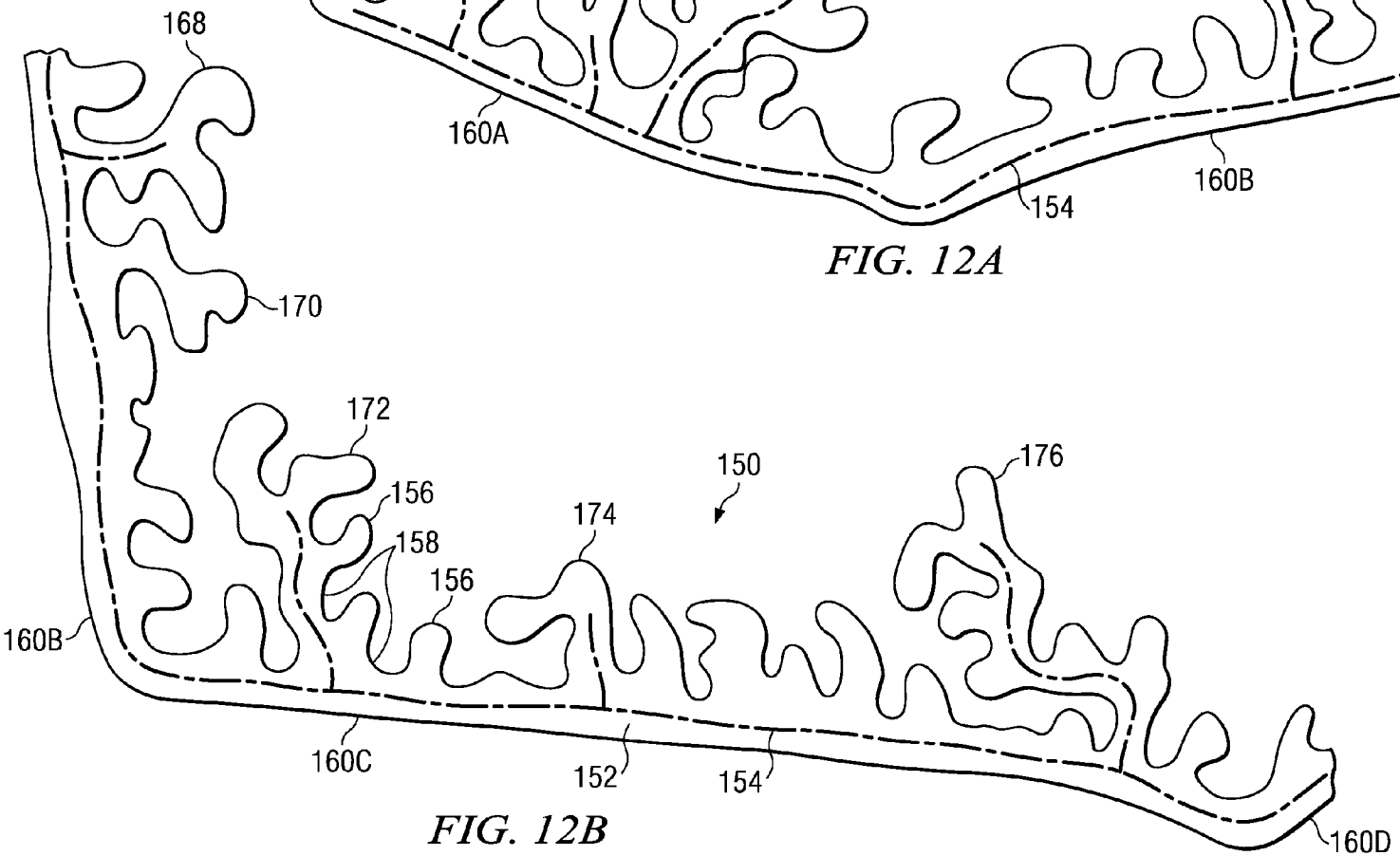
Figure 12C:
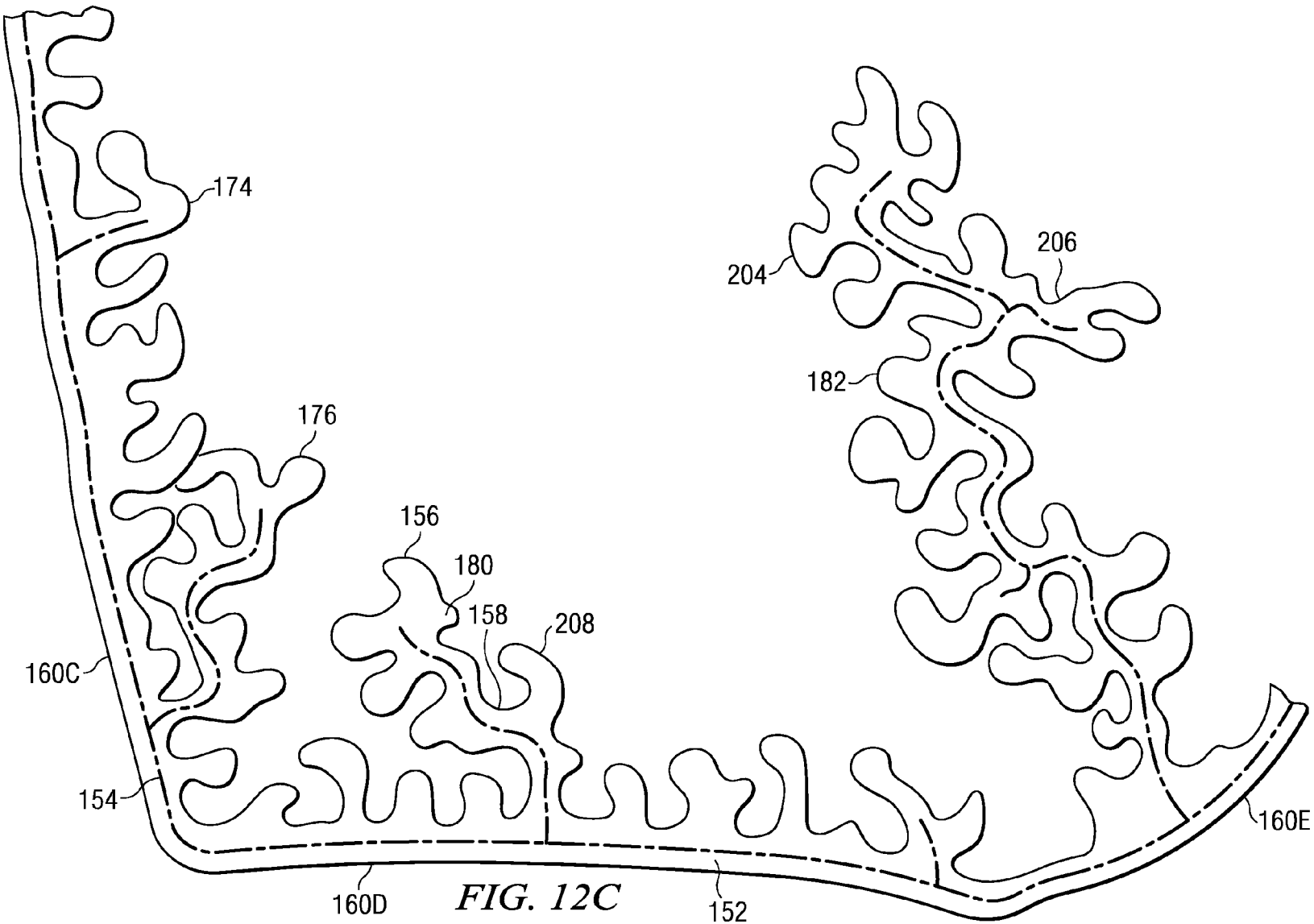
Figure 12D:
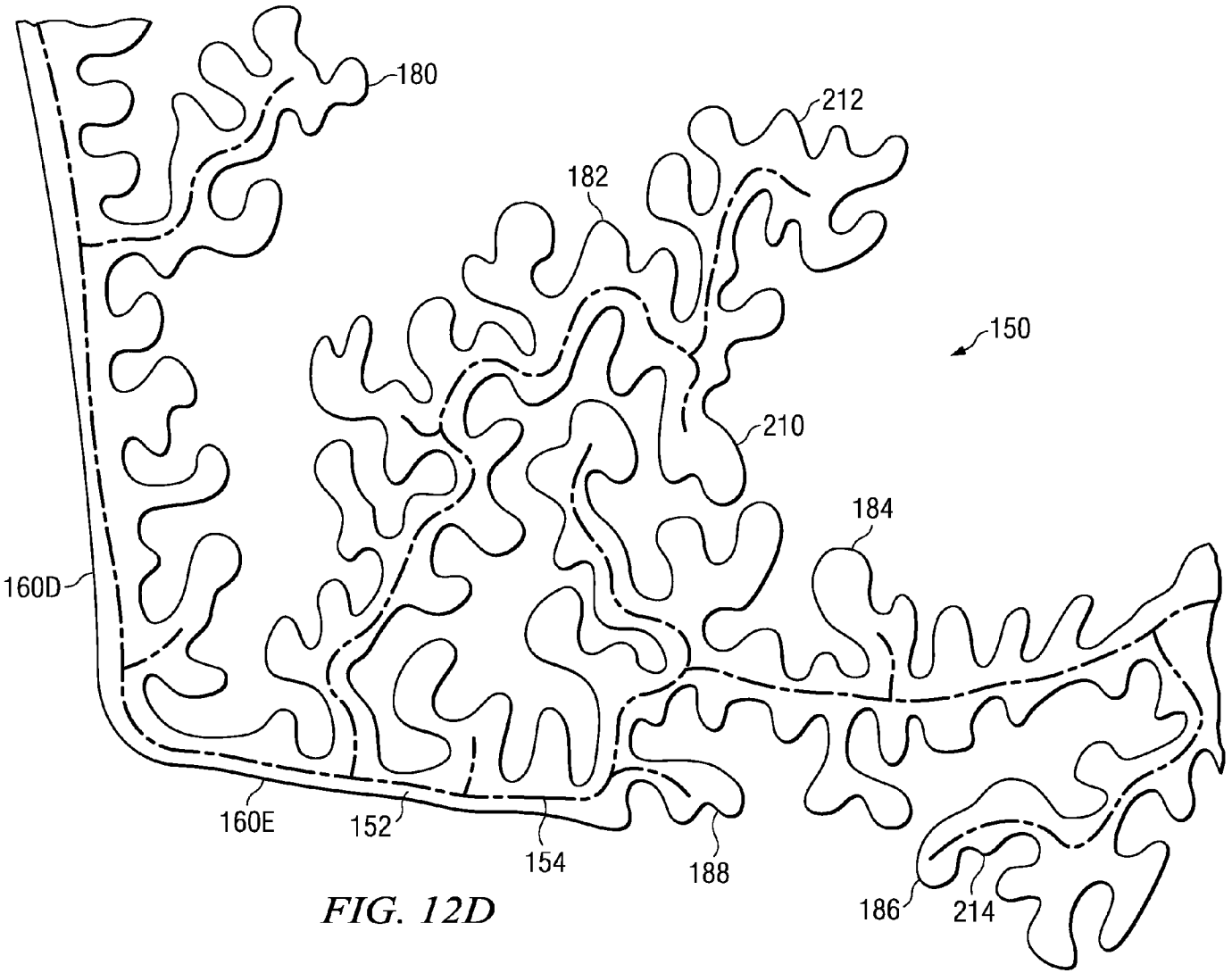
Figure 12E:
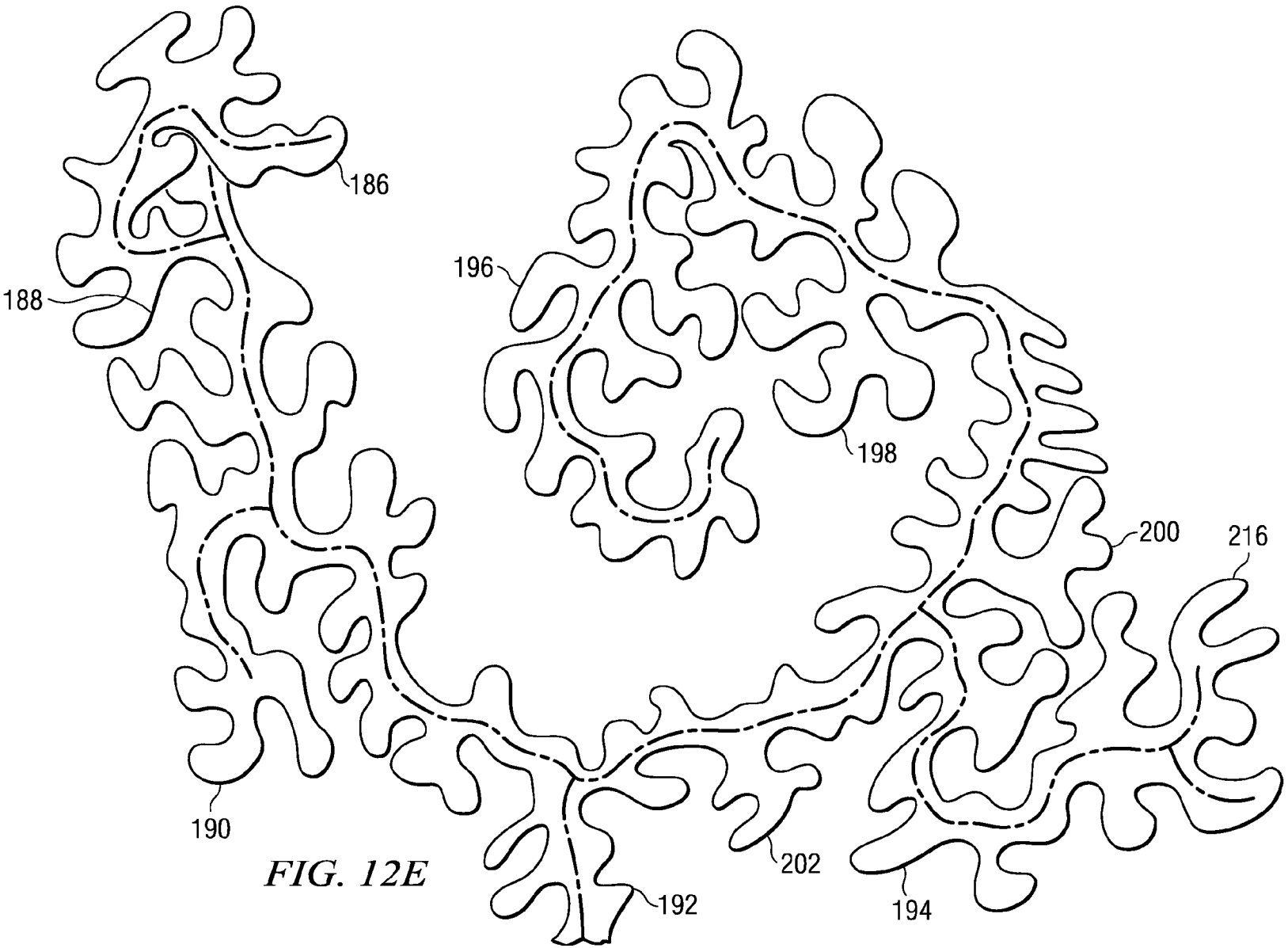
Figure 12F:
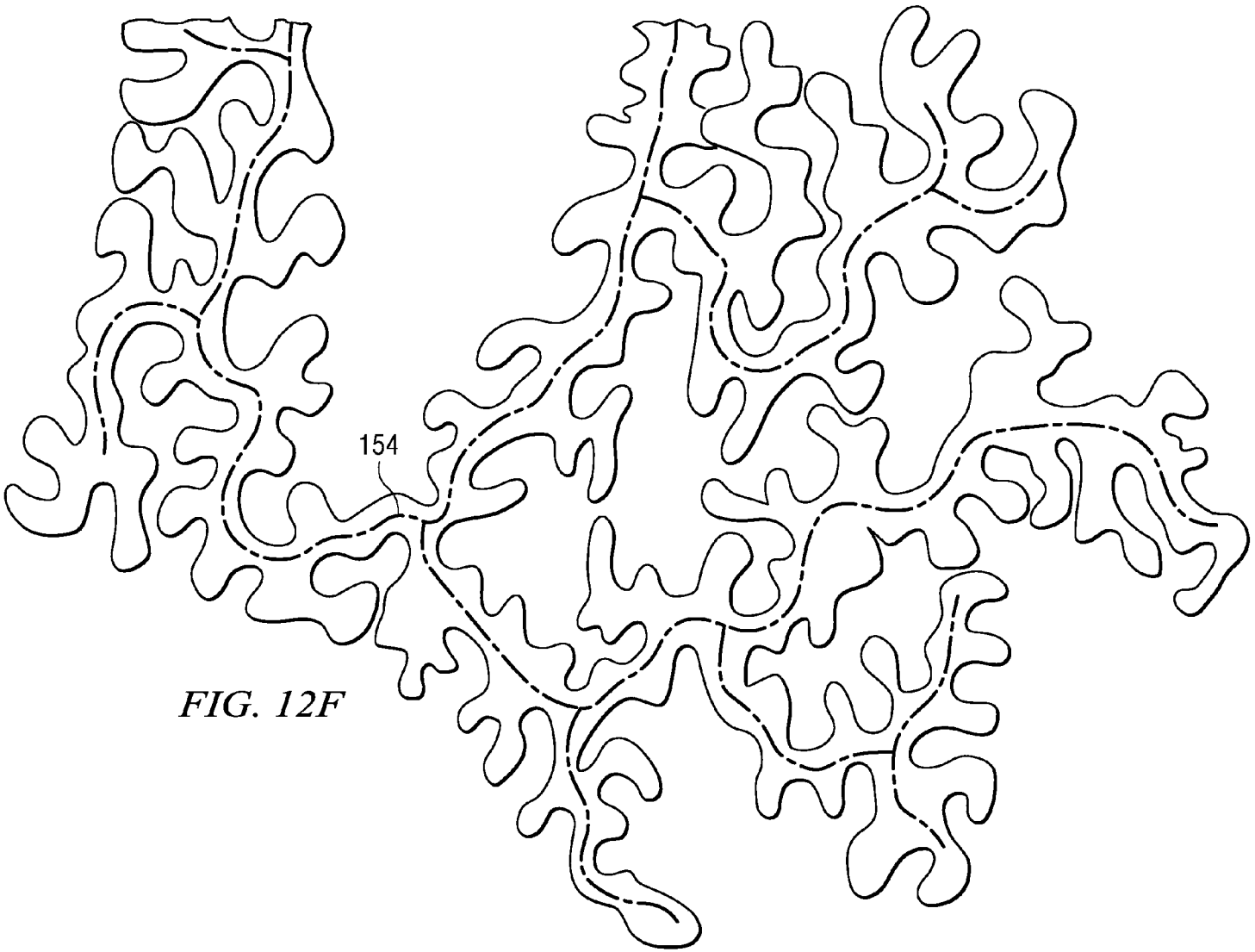

FIG. 11 is a top view of a two-dimensional puzzle 150 which is made up by a single puzzle piece 152. A center line or axis 154 is shown in dark line, along with the center lines of the principal branches of the piece. In this illustrated embodiment, the piece 152 has several nodules 156 and embayments 158 along the length of the piece and each of its principal branches, all of which cooperate to knit the puzzle together. To be acceptable the puzzle piece 152 must interlock with itself (or with the other pieces, if any) in some fashion, at least by the use of such nodules and embayments and more preferably also by the use of extensive, highly elongated and/or fractal branching of the piece. One end or portion 160 of the puzzle piece 152 acts to form the periphery of the assembled puzzle, containing the rest so as to provide an element of structural integrity to the puzzle in its assembled condition.

FIGS. 12A-12F are portions of puzzle piece 152 in a stretched-out condition. The puzzle piece 152 has a main axis, indicated by dark line 154, and several branches 162-202 off of this main axis. At least certain ones of the branches 162-202 have sub-branches such as those shown at 204-216. The degree of branching and sub-branching can proceed in fractal or dendritic fashion until the desired degree of complexity is achieved. The external periphery of the rectangular body into which this piece 152 is assembled can be seen, as somewhat plastically distorted, at 160A-160E, sides 160A and 160E being pieced together to form a whole side of the rectangle. In the embodiment shown, an initial length 160 of the piece 152 is used to form the periphery of the assembled puzzle, as the assembled puzzle then does not come apart as easily. The remainder of the puzzle piece(s) fit into a puzzle interior. This is an optional characteristic and the piece or pieces can be cut otherwise. Evident from FIGS. 11 and 12A-12F are the facts that a length of the puzzle piece (along line 154) is many times or even an order of magnitude greater than the length of the assembled puzzle. Likewise, the perimeter of piece 152 is many times or even an order of magnitude greater than a perimeter of the assembled puzzle 152.

Figure 13:
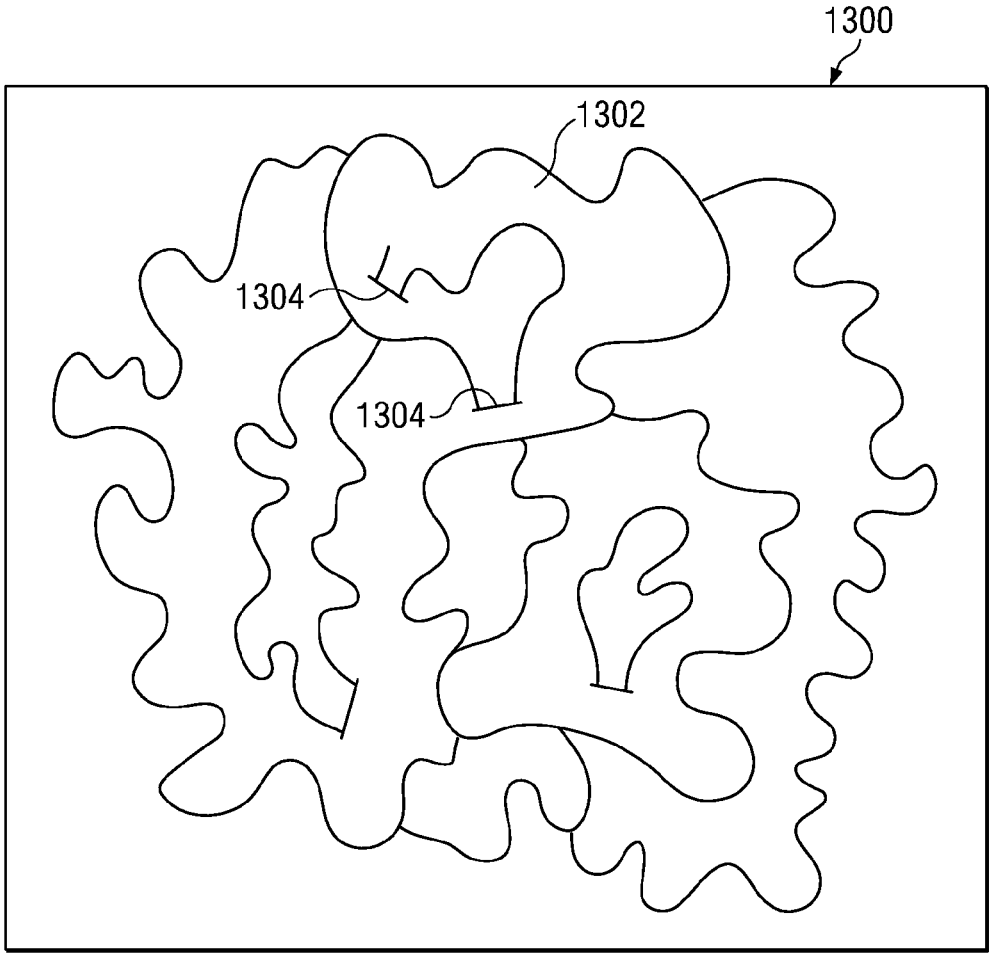
FIG. 13 is a view of another embodiment of the invention in which at least one puzzle piece is woven through slits in the same or another piece.

FIG. 13 shows another embodiment 1300 of the present invention wherein the long puzzle piece 1302 is interposed or interwoven as part of the puzzle solution with slits 1304 for receiving the long puzzle piece creating an interwoven puzzle assembly. The interwoven puzzle assembly provides a three dimensional enhancement if there is a picture or pattern image on one side. For example, an image picturing water inserted under a section of puzzle piece picturing a bridge would provide a three dimensional view. The interwoven assembly also increases the difficulty.

Figure 13A:
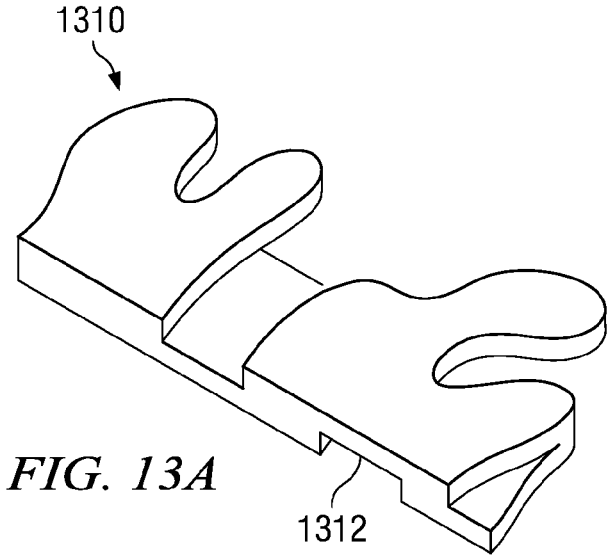
FIG. 13A is an enlarged view of a section of puzzle piece showing the possibility of a puzzle piece topography including raised portions and notches.

FIG. 13A is a sectional view showing portion 1310 of an elongated puzzle piece (the piece in its entirety having a length which is much greater than either its width or its depth) having a slot or lower portion 1312 in a depth direction that can receive in mating fashion a correspondingly raised portion (not shown) on the same (1310) or another puzzle piece. Also it should be understood that notches could be mortised, that is having complementary notches in both piece lengths, or in just one such length. There can be one or multiple interweaving or overlayments throughout the puzzle. Puzzle piece 1310 can therefore have interlocking elements in both directions normal to its length, i.e. its width and depth.

Figure 14:
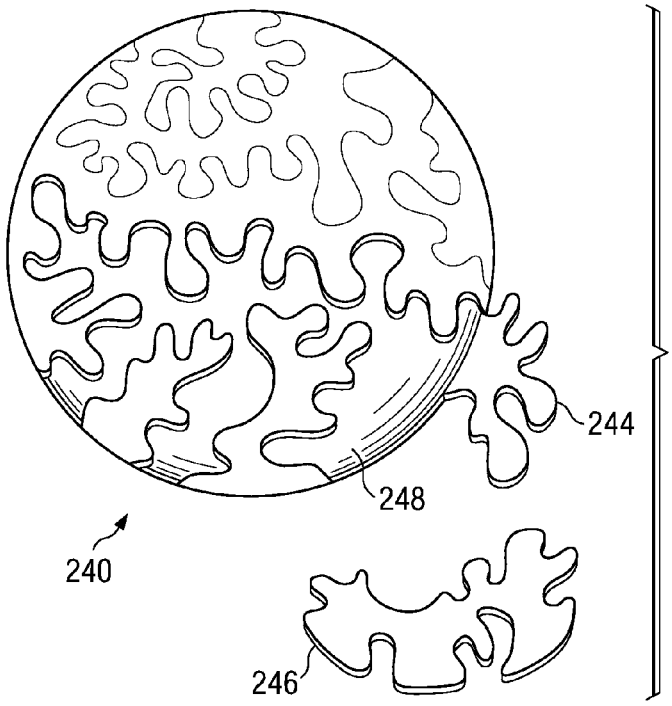
FIG. 14 is a view of an embodiment of the invention in which multiple puzzle pieces are applied to a spherical mandrel or support surface.

FIG. 14 shows another embodiment 240 of the present invention wherein the puzzle piece 244 or 246 attaches or adheres to a support surface formed by a mandrel of any of many preselected shapes, in this instance a sphere 248, by various means, including but not limited to releasable adhesive, electrostatic cling, snaps, hook and loop fasteners or in the case of magnetic surfaces, such as iron or sheet steel, including a magnetic material in the basic plastic and/or rubber material of one of the puzzle pieces 244, 246 or mandrel or support surface 248. The structure 248 can be a shell or solid, and instead of the exemplary simple geometric shape can be more complex, and can take the shape of a person, article or other known object.

Figure 15:
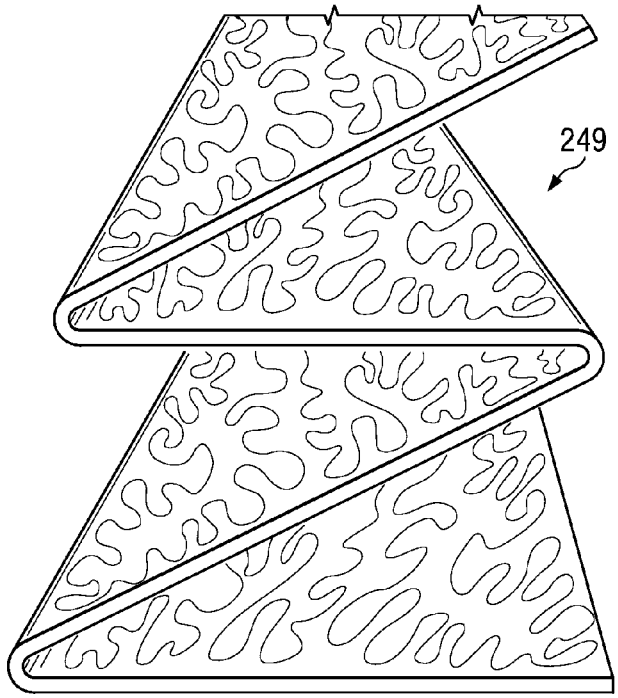
FIG. 15 is a view of a folded embodiment of the invention.

FIG. 15 shows the flexibility of a puzzle embodiment 249 suitable for folding or layering, and then stored in a relatively small place such as a book bags or a purse.

Figure 16:
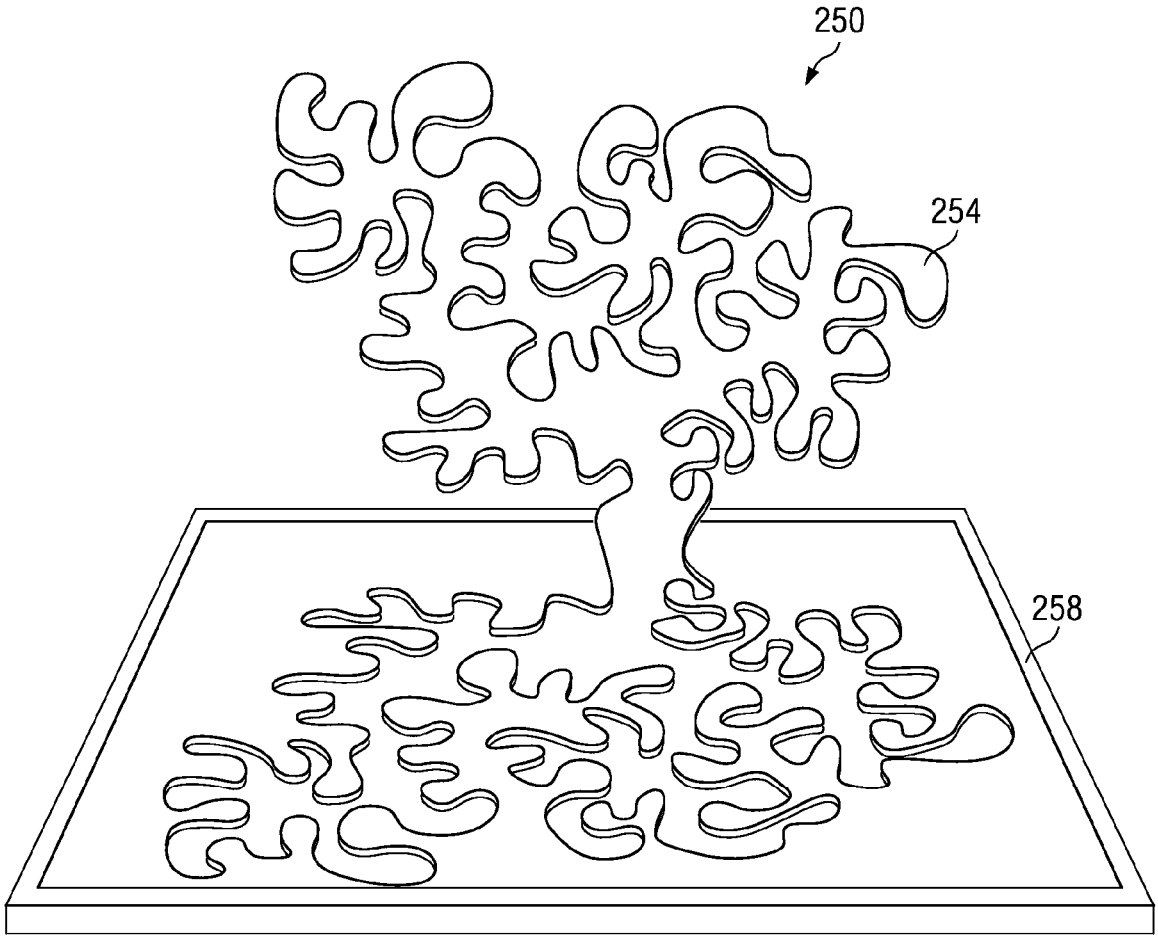
FIG. 16 is a view of an embodiment of the invention in which one portion of a puzzle piece is attached to a frame.

FIG. 16 shows an embodiment 250, in which a single puzzle piece 254 is attached at some point to a frame 258 providing a convenient area to solve the puzzle and storage for the puzzle when not in use. It should be understood that there could also be several of such attached puzzle pieces forming the puzzle. In an embodiment alternative to this, the puzzle piece 254 would not be permanently attached to the frame 258, or would be applied in place with an adhesive by the user. The use of a regular frame 258 which is not a part of the puzzle body permits the outline of the puzzle body to be irregular and therefore harder to solve, but in this instance when the puzzle is complete the assembly nonetheless has an aesthetically pleasing regular appearance.

Figure 17:
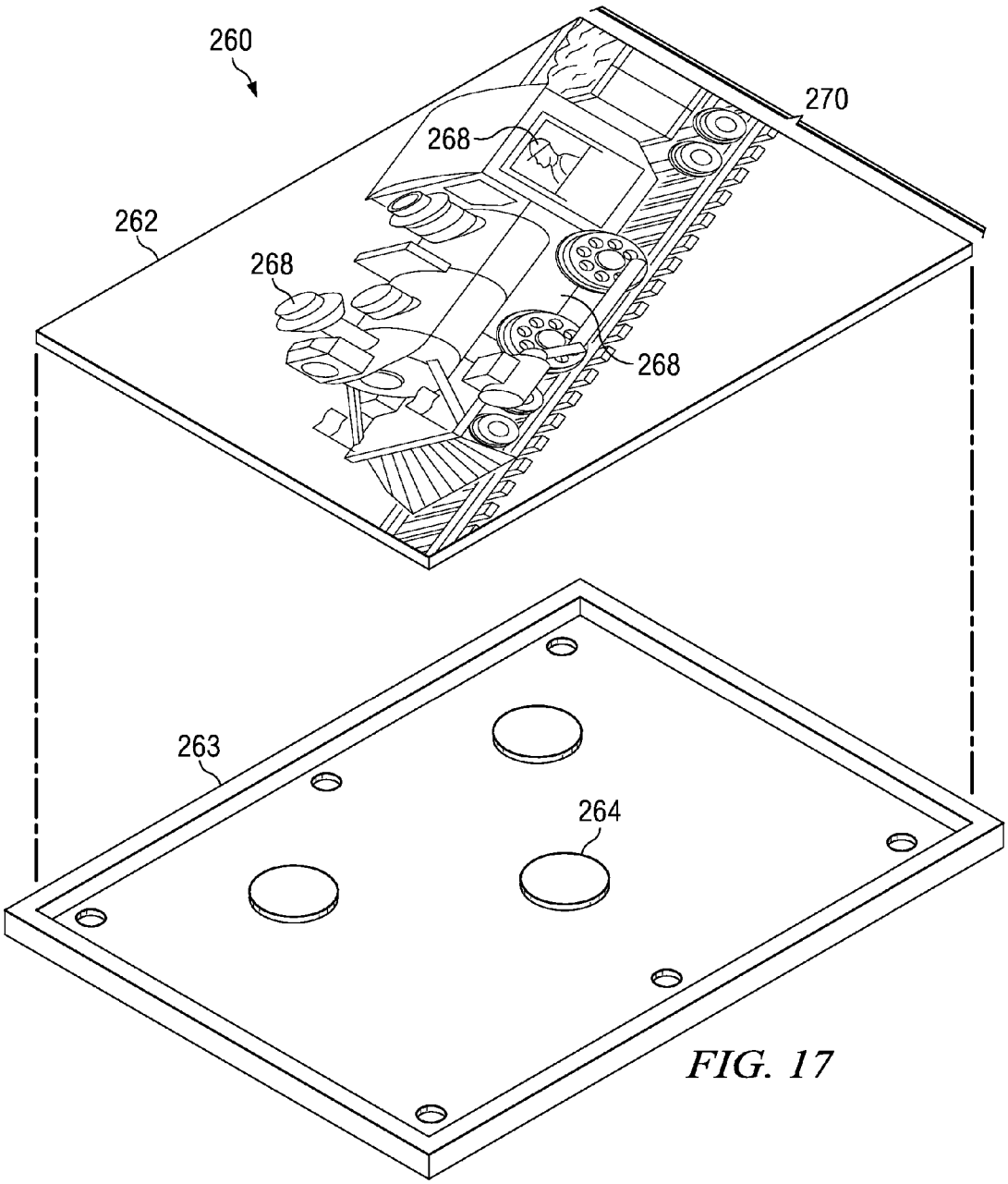
FIG. 17 is a view of an embodiment of the invention in which an assembled image interacts with electronic elements in a frame.

FIG. 17 shows another embodiment 260 of the present invention wherein the puzzle 262 is in a frame 263 which contains interactive points, such as pressure sensors 264, that can be connected to a battery or computer (not shown) which could be in a self contained chip in the puzzle (or frame thereof) to emit audio, visual or tactile responses upon depressing the sensors 264 that are related to the components 268 of the image 270. Such self contained interactive chips would be similar to those found in greeting cards. For example, depressing the sensor 264 under a train component 268 of the image 12 would emit a train movement sound, whistle, or train bell sound. The puzzle could also be linked by wire or wireless to a computer such as a PC (not shown).

Figure 18:
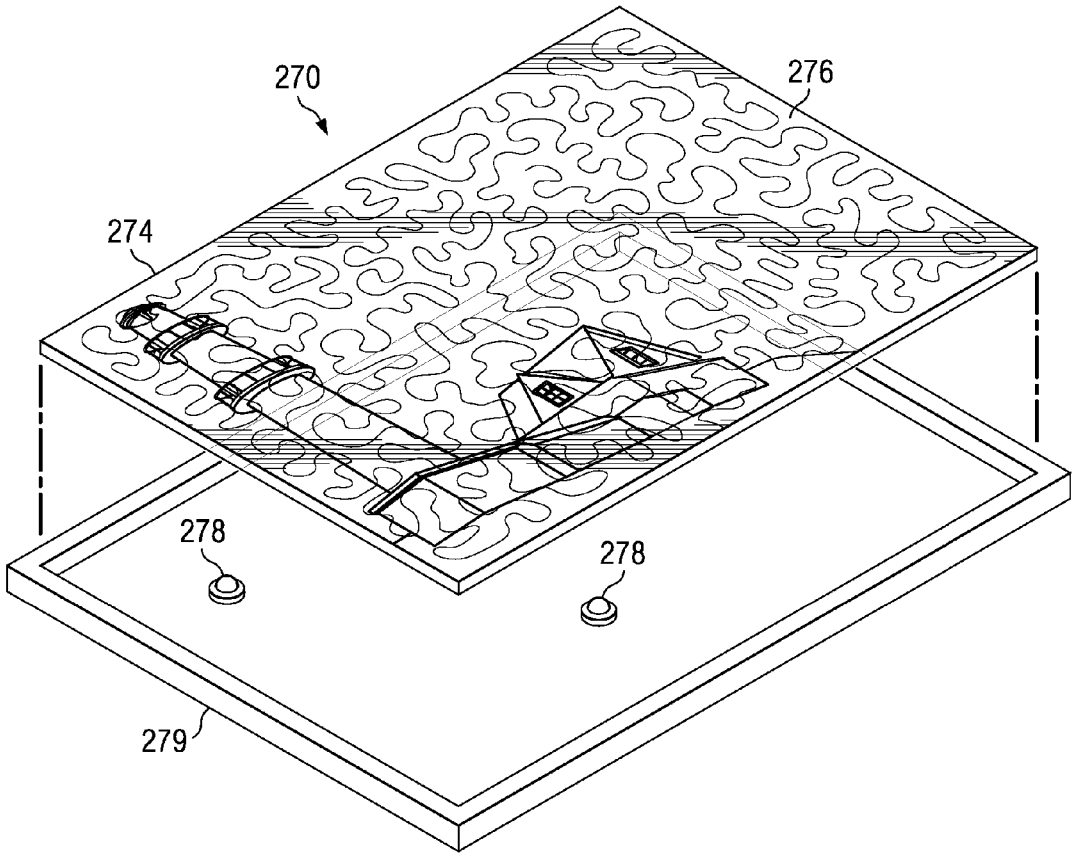
FIG. 18 is a view of an embodiment of the invention incorporating transparent or translucent elements, and illuminated by lighting elements.

FIG. 18 shows another embodiment 270 of the present invention wherein the puzzle piece 276, or portions thereof, are made of a transparent or translucent material, such as a vinyl or foam 274, which can be illuminated by bulbs or other illuminating devices 278 positioned in a frame 279. The bulbs or other illuminating devices would be connected to batteries (not shown) or other power source.

Figure 19:
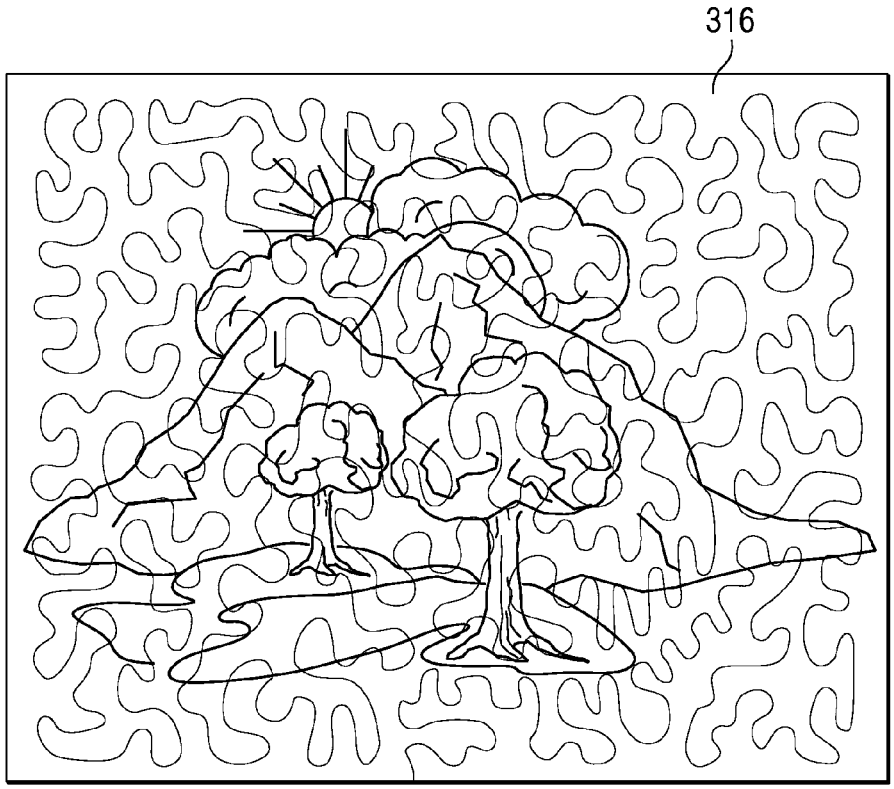
FIG. 19 is a plan view of an image after it has been die cut into puzzle pieces.
Figure 20:
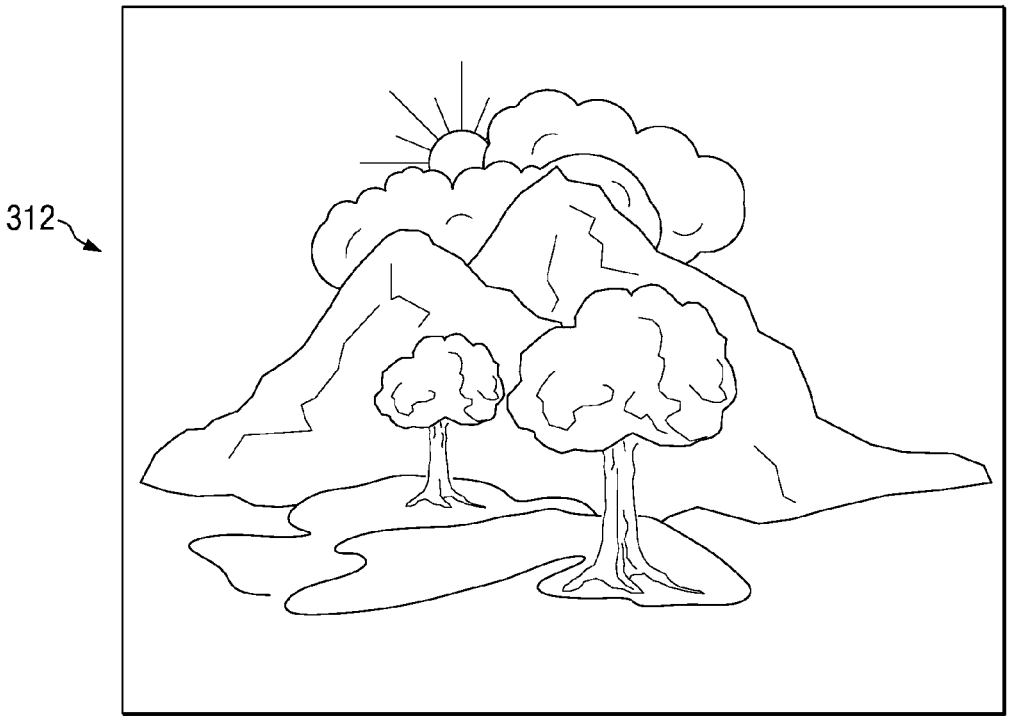
FIG. 20 is a plan view of the image of FIG. 19, prior to its being cut into puzzle pieces.

FIG. 20 shows a typical image 312 printed on the puzzle material rubber or foam similar say to a computer mouse pad, prior to cutting into puzzle pieces. FIG. 19 shows the image on the puzzle material after it had been cut to form the single or more puzzle piece 316.

Figure 22:
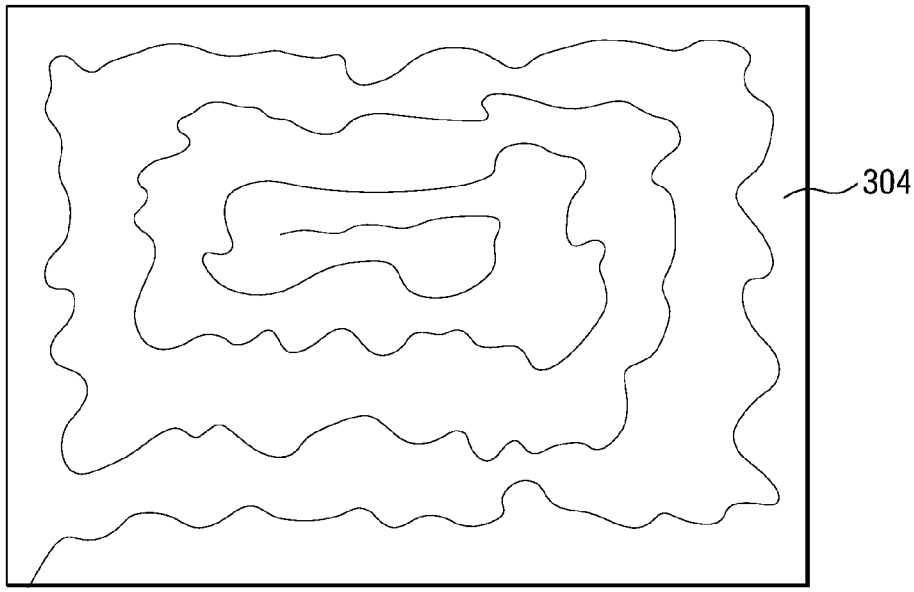
Figure 23:
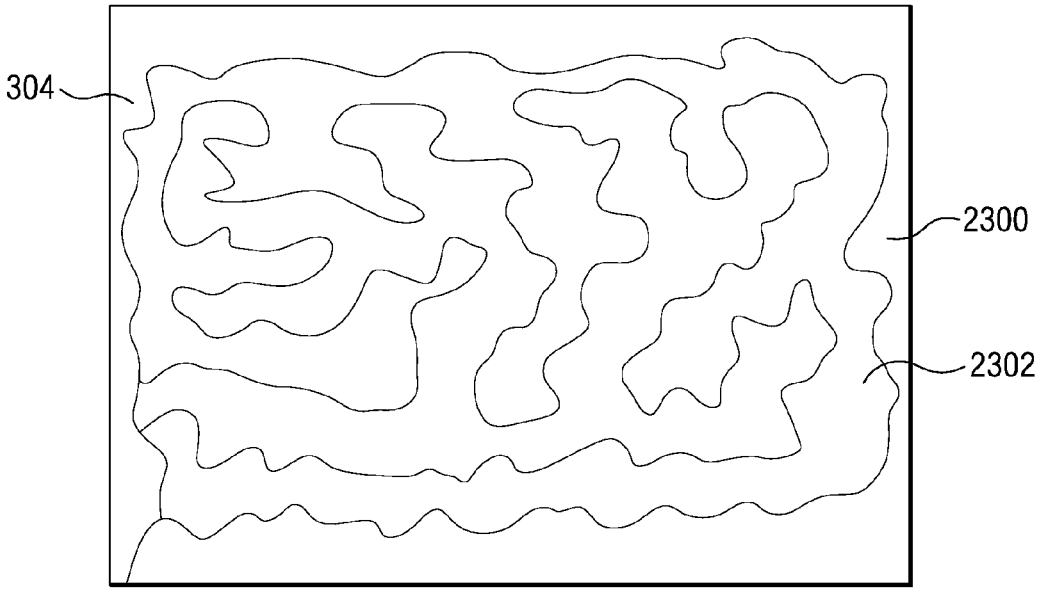

FIGS. 21-23 are embodiments of the present invention wherein a puzzle surface 304 is a material such as vinyl which contains no image, but can be drawn upon with, for example, non permanent color markers (not shown) and the drawing thereby produced can be easily removed with a cloth or other cleaning device. This allows the user to create his or her own puzzle image for solution. FIG. 22 in particular shows a blank embodiment in which an initial portion of a single puzzle piece forms a frame, and a remainder of the piece is placed interior to this. FIG. 23 shows a two-piece embodiment including a peripheral frame member 2300 and an interior piece 2302.

Figure 24:
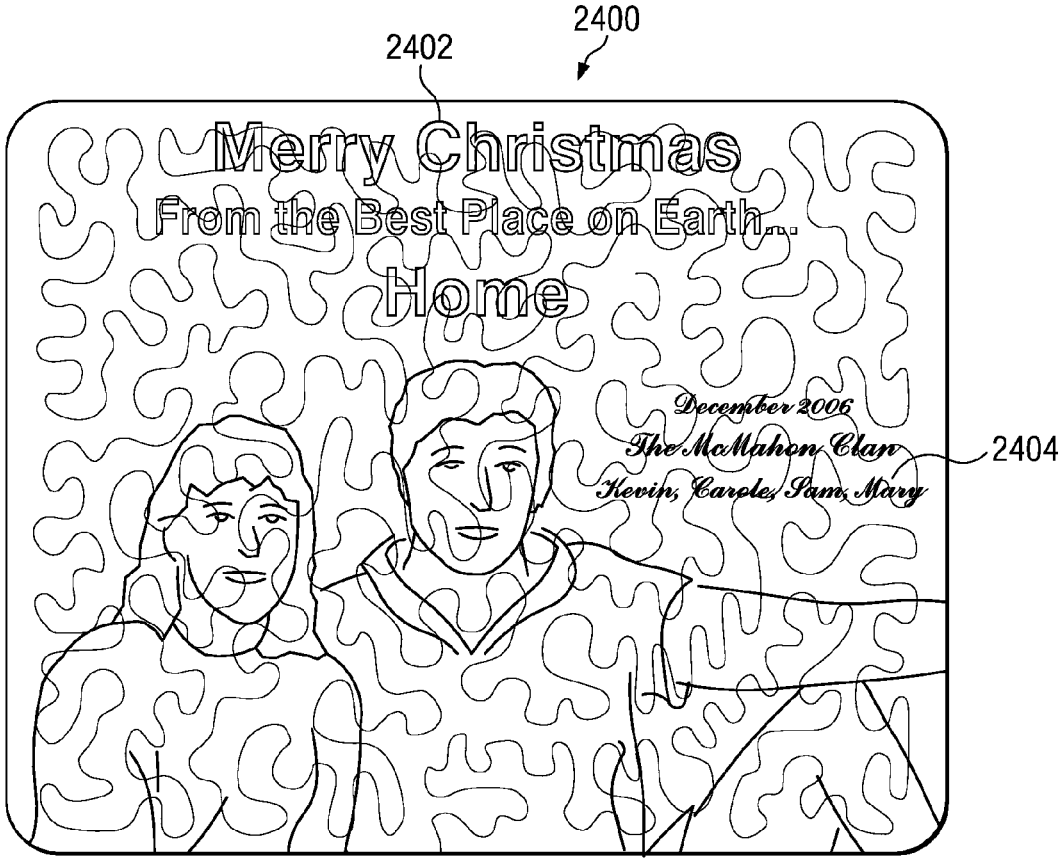
FIG. 24 is a view of an embodiment of the invention used as a holiday card or greeting, in a first configuration.

FIG. 24 shows the use of a puzzle 2400 as a holiday gift or greeting. The image 2402 can relate to the holiday, for example hearts for Valentine's day, birthday, Easter, and Christmas and the puzzle can be personalized with printed material 2404 from the sender or giver. Of course, it could also relate to business or product information and be used as a premium, incentive or reward.

Figure 25:
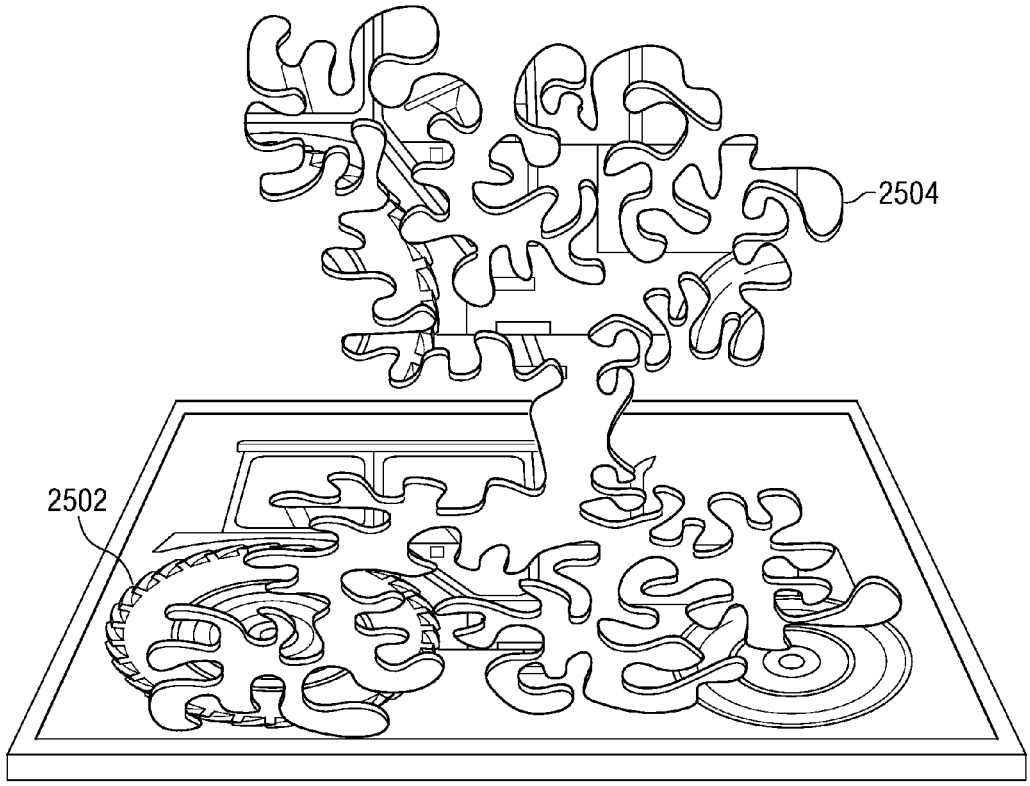
FIG. 25 is a view of the embodiment of the invention shown in FIG. 24, shown in a second configuration.

In FIG. 25, another version of the puzzle 2500 is shown and has an image 2502 thereon, with an initial portion of puzzle piece 2504 attached thereto and a terminal portion of piece 2504 being free. In this embodiment of the present invention, the piece 2504 is made by providing a plastically flexible, flimsy or floppy material (soft rubber, foam rubber, cloth, leather, various plastics or any material of the same consistency) and cutting it in an irregular pattern in which the cutting line never crosses itself, thus maintaining one piece. The difficulty of the puzzle can be regulated in various ways.

Figure 26:
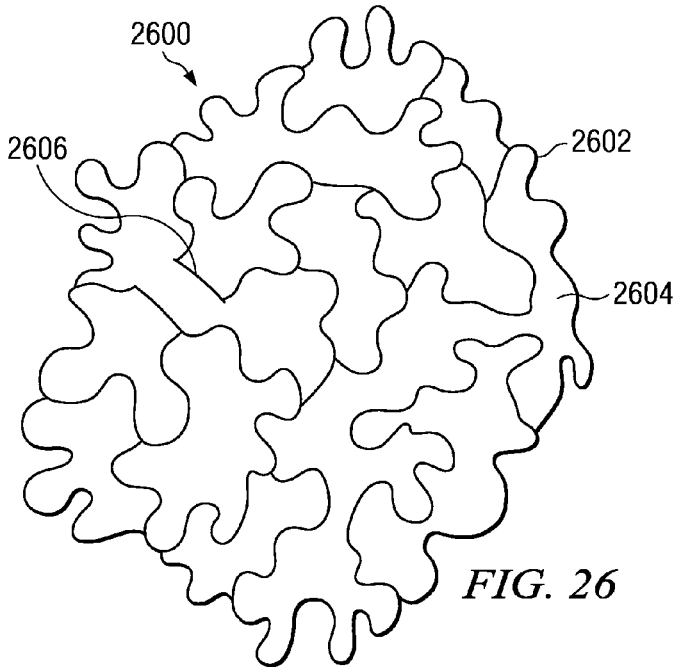
FIG. 26 is a view of an embodiment of the invention in which at least one puzzle piece crosses itself or another piece.

FIG. 26 shows an embodiment 2600 with an irregular periphery 2602 and at least one piece 2604 which crosses over itself at locations 2606. The puzzle designer can choose to notch or mortise these crossover points, per FIG. 13A, in order to flatten out the puzzle or provide the user clues on how it might be assembled, or alternatively can intentionally leave the puzzle thicker at those points for more puzzle three-dimensionality.

An image can be printed on one or both sides of the puzzle in a way to either help or confuse the user.

Both the width and thickness of the piece directly affects the flexibility of the piece. The more flexible the piece the harder it is to manipulate. The initial material can be made thinner or thicker and the design of the cut can make the piece wider or narrower. The flexibility, plasticity and elasticity of the piece(s) can be chosen to increase or ease difficulty.

The puzzle can also be made into multiple pieces by allowing the line of the cut to contact or cross itself (see FIG. 23). The number of times this happens will increase the difficulty of the puzzle and will also affect the thickness and width of the piece.

The puzzle in any of its illustrated or other embodiments may have a complementary scent.

The puzzle can be made by taking a sheet or web of, for example, elastomeric or other flexible polymeric foam or other material of similar consistency, about 1/16 to 1/4 inch thick and gluing printable material (such as a cellulosic fibrous material or other cloth-like material or fabric) to both sides. FIGS. 11 and 12A-12F show a representative embodiment of this sort. This material has two functions. It allows images to be printed on the puzzle, and it enhances the puzzle's strength and durability. A composite construction such as this one makes the puzzle more difficult to rip apart or damage. The puzzle body can be formed of other laminates or composites with these goals in mind, and also as a means to regulate, vary or specify the puzzle body's physical properties.

Once the printable material is on it, the puzzle body will go to the printing press where various images will be printed on one or both sides.

It will then go to the cutting press where a steel rule die will stamp the cut design into the puzzle and shape the puzzle to its final shape.

It will then be packaged and sent out for distribution.

The puzzle can be marketed as a novelty game for adults and children as well as a tool to be used in the rehabilitation industry for manipulation skills.

In making cross over piece puzzles, they too can be cut from a single sheet by splaying or placing the pieces to be cut in a spaced apart manner, then cutting the pieces. When such a puzzle is assembled, the pieces can be made to overlap, cross over or interfit, such as through cut slots or slits.

While various embodiments of puzzle of the present invention has been shown, it should be understood that the present invention extends to the method for making and for solving the puzzle concept of the invention as well as to the various puzzle embodiments shown therein and various alternatives. It should be understood that an alternative or disclosure with respect to one embodiment therein could be extended to any of the embodiments shown or other puzzle concepts discussed herein. For example, a volume puzzle, say of layers, could have sharp corners or not have sharp corners, could have random surfaces or a flat surface, or could have image clues on one or more parts of the puzzle.

The present invention can take embodiments other than the ones shown. For example, a volume puzzle of, say, layers could have sharp corners or not have sharp corners, could have random surfaces or a flat surface, or could have image clues on one or more parts of the puzzle.

The method of making the puzzle depends on the nature of the substrate from which the puzzle is made and the shapes of the pieces from which the puzzle is constituted. The puzzle could be made of elastomeric foam, certain plastics, leather, thick cloth, other fibrous sheets, or composites of all of the foregoing, as long as the chosen material is plastically flexible so that it can be bent out of or into shape and retain that condition. The pieces could be one or multiple and made as a single piece and then cut. Further, a user, after having solved the puzzle and seeing little challenge left in it, could increase the difficulty by cutting the puzzle piece or pieces into more pieces, or dividing individual branches or sub-branches into more branches or sub-branches. This last characteristic of modifiability is not found in conventional, highly multiple-piece puzzles.

It is preferred that the material from which the puzzle is made be plastically flexible yet substantially dimensionally stable. Rigid materials are not as capable of rearrangement without fracture or cracking, and highly elastic materials will tend to spring back to their original shapes, defeating the disassembly needed to turn the object into a puzzle to be solved. While the material should be flexible, it should not exhibit a large tendency to permanently deform or stretch out of shape, as it will then not be easily capable of reassembly. For substantially two-dimensional embodiments of the invention such as those shown in FIGS. 1-5 and 11-12F, a flexible mouse pad substrate, or a sheet of material from which such mouse pads (and also wet suits) have been made in the past, has been found to have useful properties of flexibility, only a low amount of elasticity, but considerable dimensional stability, image printability, and sufficient durability to survive extensive handling. Mouse pads having utility in forming substrates for the invention comprise a central layer of polyurethane or similar flexible elastomeric foam and bottom and top fabric layers. Conventional flexible mouse pads take images easily and can be easily die-cut to create one or more puzzle pieces.

A further general characteristic of the invention is that preferably the length of the periphery of the puzzle piece in its disassembled condition must be much greater than the length of the periphery of the assembled whole, typically by at least one order of magnitude. This is the case for both substantially two-dimensional embodiments and more fully three-dimensional embodiments. In the two-dimensional case, the length of the margin or periphery of the puzzle piece is typically many times that of an external periphery or circumference of the assembled puzzle. In the three-dimensional case, the surface area of the puzzle piece(s) is much larger, preferably by one or more orders of magnitude, than the external surface area of the puzzle after assembly.

In a preferred embodiment, the puzzle piece or pieces each are greatly elongated in a disassembled condition relative to the longest dimension of the assembled puzzle. In one embodiment, a single piece constituting the entirety of a flat, rectangular puzzle has a length of about 54 inches, while the longest dimension of the rectangle which it makes is ten inches. Where a branched puzzle piece is used, such as that shown in FIGS. 11 and 12A-12F, a length of at least one of the branches is typically many times its depth or width, and preferably many times a length of the assembled puzzle.

Figure 27:
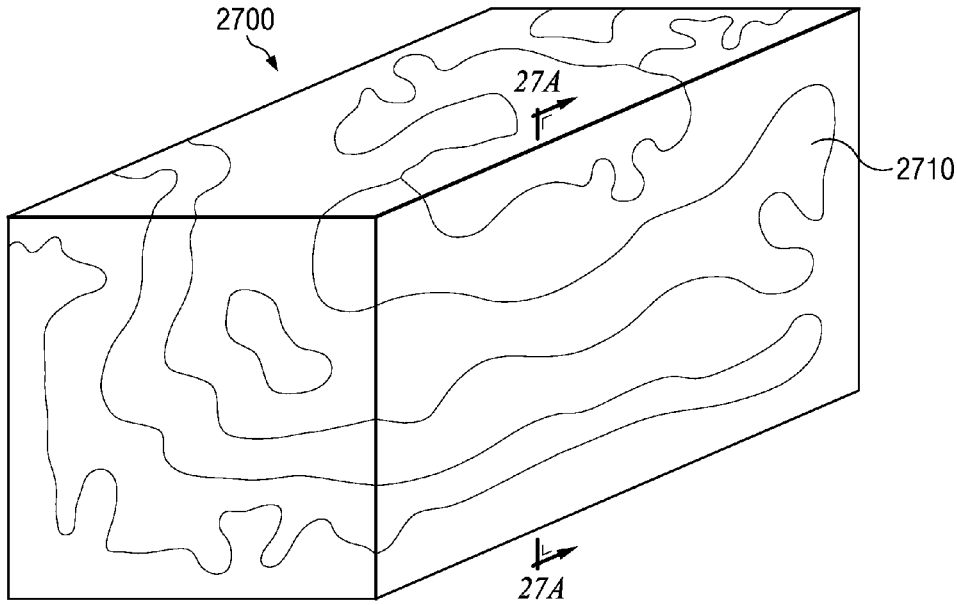
FIG. 27 is a view of a three-dimensional block embodiment of the invention.
Figure 27A:
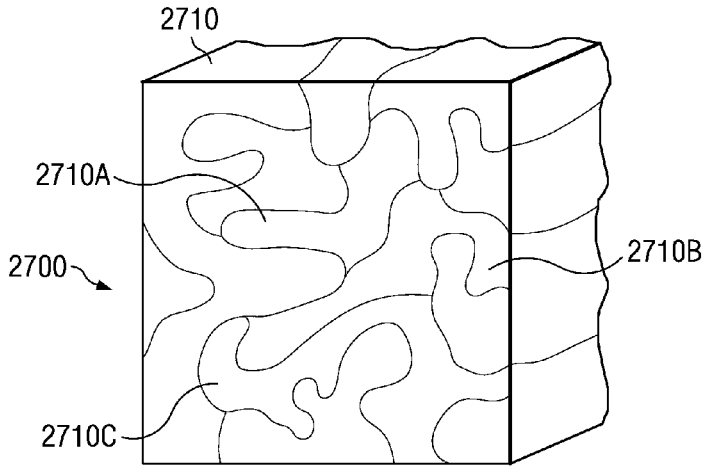
FIG. 27A is a sectional view taken substantially along Line 27A-27A of FIG. 27.

FIG. 27 shows a three dimensional volume puzzle embodiment 2700 of the present invention in the form of a block which is made up of a single piece 2710. FIG. 27A is a sectional view which shows how portions 2710A, 2710B, 2710C, etc. of the puzzle piece 2710 wind their way through the interior of the puzzle volume.

For flat, planar embodiments, a straightforward way to manufacture the puzzle is to take a sheet of material having the requisite characteristics of plastic flexibility but dimensional stability, define an outer margin of the completed puzzle, and within that margin die-cut one or more puzzle pieces out of it. In a more three-dimensional embodiment, in one preferred method of manufacture the solid shape is made first, and then at least one piece is carved out of it. One way of proceeding would be to remove the solid, elongated puzzle piece from the workpiece in layers in a somewhat helical fashion, much like peeling the skin from an apple, and then continue with deeper layers once an initial layer of the puzzle piece has been completely disassociated. Another method of fabricating a three-dimensional puzzle is to separately mold the individual piece(s) in their elongated condition.

In summary, novel aspects of a puzzle have been shown and described. The puzzle is composed of one or only a few pieces, and relies on the plastic flexibility of the great length and/or branches of these piece(s) to create the disorderedness which the user must overcome in solving the puzzle.

While illustrated embodiments of the present invention have been described and illustrated in the appended drawings, the present invention is not limited thereto but only by the scope and spirit of the appended claims.

I claim:

1. A puzzle comprising a single, contiguous puzzle piece having a plurality of elongate branches, each branch having at least one free end, with at least two of the branches having a respective width and depth, a length of each of the at least two branches being at least an order of magnitude greater than the width or depth thereof, the single piece, including its branches, being formed of a material which is substantially dimensionally stable but is substantially uniformly plastically flexible between a disordered condition and a stable condition, so that the single piece, including its branches, is capable of movement in any of an infinite number of directions, wherein each of the branches have along their respective lengths a plurality of nodules and embayments by which the branches interlock with each other into an assembled condition and wherein the puzzle in its assembled condition is substantially flat and two dimensional.

2. A puzzle according to claim 1, wherein the single piece, including its branches, is formed of a composite material.

3. A puzzle according to claim 2, wherein the single piece, including its branches, is formed from an elastomeric foam interposed between layers of fabric.

4. A puzzle according to claim 1, wherein the length of at least one of the branches is greater than the length of the puzzle in its assembled condition.

5. A puzzle in accordance with claim 1, wherein the puzzle, in its assembled condition has a periphery, a first portion of the single piece forming the periphery of the puzzle, a remainder of the puzzle piece being assembled into the puzzle to be interior to the first portion of the puzzle.

* * * * *